US009312119B2

(12) United States Patent
Verenchikov

(10) Patent No.: US 9,312,119 B2
(45) Date of Patent: Apr. 12, 2016

(54) OPEN TRAP MASS SPECTROMETER

(75) Inventor: Anatoly Verenchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 153 days.

(21) Appl. No.: 13/582,535

(22) PCT Filed: Dec. 30, 2010

(86) PCT No.: PCT/IB2010/056136
§ 371 (c)(1),
(2), (4) Date: Nov. 14, 2012

(87) PCT Pub. No.: WO2011/107836
PCT Pub. Date: Sep. 9, 2011

(65) Prior Publication Data
US 2013/0056627 A1 Mar. 7, 2013

(30) Foreign Application Priority Data
Mar. 2, 2010 (GB) ..... 1003447

(51) Int. Cl.
*H01J 49/40* (2006.01)
*H01J 49/48* (2006.01)
(Continued)

(52) U.S. Cl.
CPC ..... *H01J 49/406* (2013.01); *H01J 49/282* (2013.01); *H01J 49/40* (2013.01); *H01J 49/401* (2013.01); *H01J 49/4245* (2013.01); *H01J 49/48* (2013.01)

(58) Field of Classification Search
CPC ..... H01J 49/282; H01J 49/40
USPC ..... 250/441.55, 281, 282, 286, 287, 292, 250/294, 298, 396 R
See application file for complete search history.

(56) References Cited

U.S. PATENT DOCUMENTS

2005/0045817 A1 3/2005 Yamaguchi et al.
2005/0242279 A1 11/2005 Verentchikov
2010/0044558 A1* 2/2010 Sudakov ..... H01J 49/406 250/281

FOREIGN PATENT DOCUMENTS

CN 101366097 A 2/2009
GB 2390935 A 1/2004
(Continued)

OTHER PUBLICATIONS

International Search Report for PCT/IB2010/056136, dated May 23, 2011.
(Continued)

*Primary Examiner* — Jack Berman
*Assistant Examiner* — Kevin Chung
(74) *Attorney, Agent, or Firm* — Honigman Miller Schwartz and Cohn LLP

(57) ABSTRACT

An open electrostatic trap mass spectrometer is disclosed for operation with wide and diverging ion packets. Signal on detector is composed of signals corresponding to multiplicity of ion cycles, called multiplets. Using reproducible distribution of relative intensity within multiplets, the signal can be unscrambled for relatively sparse spectra, such as spectra past fragmentation cell of tandem mass spectrometer, past ion mobility and differential ion mobility separators. Various embodiments are provided for particular pulsed ion sources and pulsed converters such as orthogonal accelerators, ion guides, and ion traps. The method and apparatus enhance the duty cycle of pulsed converters, improve space charge tolerance of the open trap analyzer and extends the dynamic range of time-of-flight detectors.

18 Claims, 10 Drawing Sheets

(51) Int. Cl.
*H01J 49/42* (2006.01)
*H01J 49/28* (2006.01)

(56) References Cited

FOREIGN PATENT DOCUMENTS

| | | | | | |
|---|---|---|---|---|---|
| JP | 2005-79037 | A | | 3/2005 | |
| WO | WO-2007044696 | A1 | | 4/2007 | |
| WO | WO 2008047891 | A2 | * | 4/2008 | |
| WO | WO 2008/059246 | | * | 5/2008 | ..... H01J 49/26 |
| WO | WO 2009001909 | A2 | * | 12/2008 | |
| WO | WO-2009110026 | A1 | | 9/2009 | |
| WO | 2010008386 | A1 | | 1/2010 | |
| WO | WO-2010008386 | A1 | | 1/2010 | |

OTHER PUBLICATIONS

German office action with its English translation for Application No. 112010005323.5 dated Feb. 21, 2014.
English Translation of Japanese Office Action for Application No. 2012-555504 dated Mar. 10, 2014.
Chinese Office Action for Application No. 201080065023.0 dated Nov. 26, 2014 with its English translation thereof.
English Translation of Japanese Office Action for Application No. 2012-555504 dated Dec. 10, 2014.

* cited by examiner

| N | T | | |
|---|---|---|---|
| | 40 | 44 | 50 |
| 20 | 800 | 880 | 1000 |
| 21 | 840 | 924 | 1050 |
| 22 | 880 | 968 | 1100 |
| 23 | 920 | 1012 | 1150 |
| 24 | 960 | 1056 | 1200 |
| 25 | 1000 | 1100 | 1250 |

| | Guessed Number of Reflections | | | | | |
|---|---|---|---|---|---|---|
| | 20 | 21 | 22 | 23 | 24 | 25 |
| Traw | | | | | | |
| 800 | **40.00** | 38.10 | 36.36 | 34.78 | 33.33 | 32.00 |
| 840 | 42.00 | **40.00** | 38.18 | 36.52 | 35.00 | 33.60 |
| ***880*** | **44.00** | 41.90 | **40.00** | 38.26 | 36.67 | 35.20 |
| 920 | 46.00 | 43.81 | 41.82 | **40.00** | 38.33 | 36.80 |
| 924 | 46.20 | **44.00** | 42.00 | 40.17 | 38.50 | 36.96 |
| 960 | 48.00 | 45.71 | 43.64 | 41.74 | **40.00** | 38.40 |
| 968 | 48.40 | 46.10 | **44.00** | 42.09 | 40.33 | 38.72 |
| ***1000*** | **50.00** | 47.62 | 45.45 | 43.48 | 41.67 | **40.00** |
| 1012 | 50.60 | 48.19 | 46.00 | **44.00** | 42.17 | 40.48 |
| 1050 | 52.50 | **50.00** | 47.73 | 45.65 | 43.75 | 42.00 |
| 1056 | 52.80 | 50.29 | 48.00 | 45.91 | **44.00** | 42.24 |
| ***1100*** | 55.00 | 52.38 | **50.00** | 47.83 | 45.83 | **44.00** |
| 1150 | 57.50 | 54.76 | 52.27 | **50.00** | 47.92 | 46.00 |
| 1200 | 60.00 | 57.14 | 54.55 | 52.17 | **50.00** | 48.00 |
| 1250 | 62.50 | 59.52 | 56.82 | 54.35 | 52.08 | **50.00** |

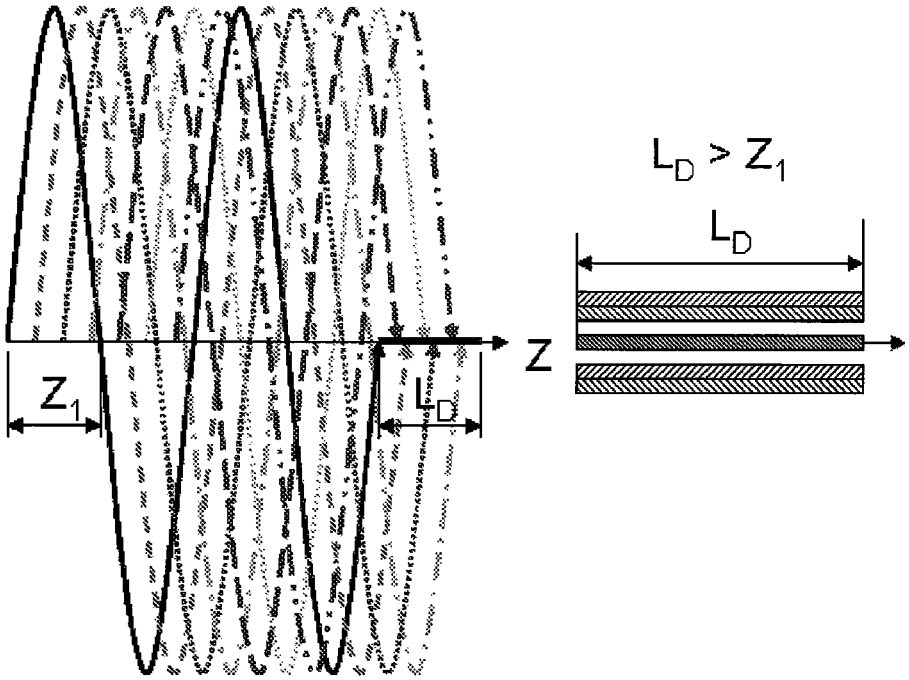
*Fig. 5A* *Fig.5B*
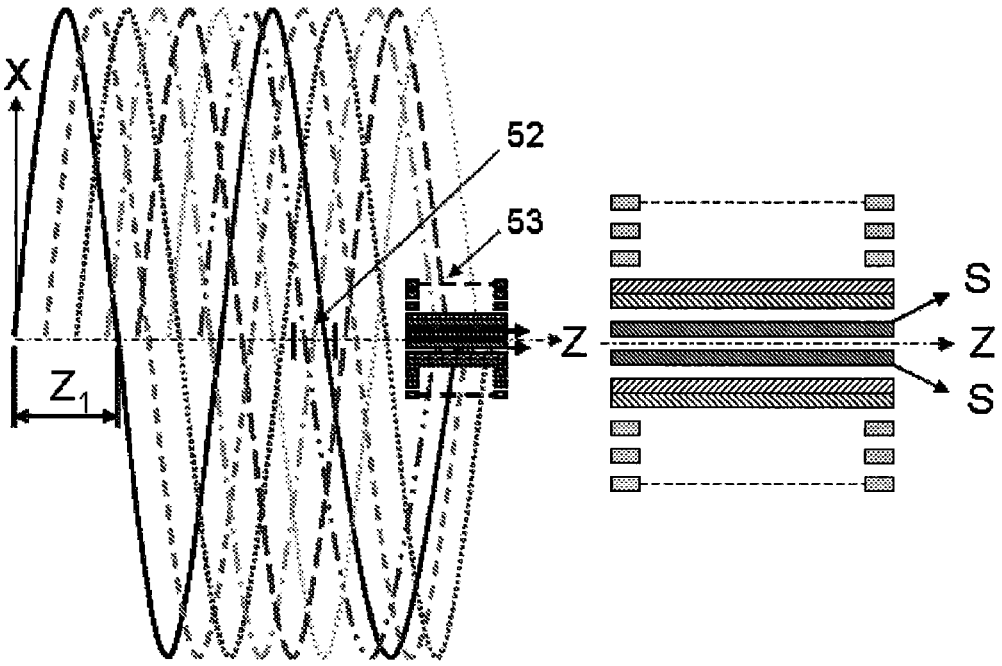
*Fig. 5C* *Fig. 5D*

OPEN TRAP MASS SPECTROMETER

CLAIM OF PRIORITY

This application is a 371 of International Application No. PCT/IB2010/056136, filed Dec. 30, 2010, which claims priority to GB1003447.8, filed Mar. 2, 2010. The entire contents of each of the above applications are incorporated herein in their entirety.

FIELD OF THE INVENTION

The invention generally relates to the area of mass spectroscopic analysis, electrostatic traps and multi-pass time-of-flight mass spectrometers, and more in particularly is concerned with the apparatus, including open electrostatic traps with a non fixed flight path, and methods of use.

DEFINITIONS

The present application proposes the novel apparatus and method herein named an 'open electrostatic trap'. It resembles features of both—conventional electrostatic traps (E-traps) and of multi-pass time-of-flight (M-TOF) mass spectrometers. In all three cases, the pulsed ion packets experience multiple isochronous oscillations (reflections or turns) within electrostatic analyzers. The difference between those techniques is defined by arrangements of electrostatic fields, by ion trajectories and by detection principles. In conventional E-Traps, the fields do trap ions in all three directions and ions may be trapped indefinitely. In M-TOF, ion packets propagate through the electrostatic analyzer along a fixed flight path to a detector. In open E-traps, ions also propagate through the analyzer while being confined in at least one direction, but the flight path is not fixed—it may contain an integer number N of oscillations within some span ΔN before ions reach a detector. Thus formed set of multiple signals for single m/z specie is named herein 'multiplet'. Thus formed partially overlapping spectra are then reconstructed while relying on mass independent amplitude distribution within multiplets and on the peak timing.

BACKGROUND

TOF and M-TOF

Time-of-flight mass spectrometers (TOF MS) are widely used in analytical chemistry for identification and quantitative analysis of various mixtures. Sensitivity and resolution of such analysis is an important concern for practical use. To increase resolution of TOF MS, U.S. Pat. No. 4,072,862 by Mamyrin et al, incorporated herein by reference, discloses an ion mirror for improving time-of-flight focusing in respect to ion energy. To increase sensitivity of TOF MS, WO9103071 by Dodonov et al, incorporated herein by reference, discloses a scheme of orthogonal pulsed injection providing efficient conversion of continuous ion flows into pulsed ion packets. It has been long recognized that the resolution of TOF MS scales with the flight path.

To raise the flight path while keeping moderate physical length, there have been suggested multi-pass time-of-flight mass spectrometers (M-TOF MS) including multi-reflecting (MR-TOF) and multi-turn (MT-TOF) mass spectrometers. SU1725289 by Nazarenko et al, incorporated herein by reference, introduces a scheme of a folded path MR-TOF MS using two-dimensional gridless and planar ion mirrors (FIG. 1). Mirror geometry and potentials are arranged to provide isochronous ion oscillations. Ions experience multiple reflections between planar mirrors, while slowly drifting towards the detector in a so-called shift direction (here Z-axis). The number of cycles and the resolution are adjusted by varying an ion injection angle. However, by principle of time-of-flight detection, the technique assumes a fixed flight path, and the number of ion reflections is limited to few to avoid overlaps between adjacent reflections.

GB2403063 and U.S. Pat. No. 5,017,780, incorporated herein by reference, disclose a set of periodic lenses within the two-dimensional MR-TOF to confine ion packets along the main zigzag trajectory. The scheme provides fixed ion path and allows using many tens of ion reflections without spatial overlapping. However, the use of periodic lenses inevitably causes time-of-flight aberrations which forces to limit the spatial size of ion packets. WO2007044696, incorporated herein by reference, suggests a scheme with double orthogonal injection in order to increase the efficiency of ion pulsed injection into planar MR-TOF. In spite of the improvement, the duty cycle of the pulsed conversion still remains under 1%. Velocity modulation within a gaseous radiofrequency (RF) ion guide prior to orthogonal acceleration improves the duty cycle by 5-10-fold.

Kozlov et al in the paper "Space Charge Effects in Multi-reflecting Time-of-flight Mass Spectrometer", Proc. of 54$^{th}$ ASMS Conference on Mass Spectrometry, May, 2006, Seattle, incorporated herein by reference, describe the use of an axial trap for ion accumulation and pulsed injection into an MR-TOF. The scheme improves the duty cycle to almost a unity and allows passing compact ion packets into MR-TOF analyzers. However, due to space charge effects, both the trap and MR-TOF analyzer rapidly saturate at ion fluxes above 1E+6 to 1E+7 ions/second (i/s). This is much smaller than can be delivered by modern ion sources providing up to 1E+9 i/s in case of ESI, PI and APCI sources, up to 1E+10 i/s in case of EI sources and up to 1E+11 i/s in case of ICP ion sources. Space charge saturation does limit the dynamic range of LC-MS and LC-MS-MS analysis, particularly when high speed of data acquisition (>10 spectra per second) is required.

Summarizing the above, the MR-TOF mass spectrometers of the prior art enhance the resolution but have limited duty cycle (and hence sensitivity) and limited dynamic range, since they cannot accept large ion flows above 1E+7 i/s from modern ion sources without degrading the analyzer parameters.

E-Trap MS with a TOF Detector:

In this hybrid-E-Trap/TOF technique, ions are pulsed injected into a trapping electrostatic field and experience repetitive oscillations along the same ion path. After some delay corresponding to a large number of cycles, ion packets are pulsed ejected onto the TOF detector. In FIG. 5 of GB2080021 and in U.S. Pat. No. 5,017,780, incorporated herein by reference, ion packets are reflected between coaxial gridless mirrors. Since ions repeat the same axial trajectory the scheme is called I-path M-TOF. Another type of hybrid M-TOF/E-trap is implemented within a multi-turn MT-TOF with electrostatic sectors. Looping of ion trajectories between electrostatic sectors is described by Ishihara et al in U.S. Pat. No. 6,300,625 and in "A Compact Sector-Type Multi-Turn Time-of-Flight Mass Spectrometer MULTUM-2", Nuclear Instruments and Methods Phys. Res., A 519 (2004) 331-337, incorporated herein by reference. In all hybrid E-Trap/TOF methods, to avoid spectral overlaps, the analyzed mass range is shrunk reverse proportional to number of cycles.

E-Trap MS with Frequency Detector:

To overcome mass range limitations the I-path M-TOF has been converted into I-path electrostatic traps in which ion packets are not ejected onto a detector, but rather an image current detector is employed to sense the frequency of ion oscillations as suggested in U.S. Pat. No. 6,013,913A, U.S. Pat. No. 5,880,466, and U.S. Pat. No. 6,744,042, incorporated herein by reference. Such systems are referred as I-path S-traps or Fourier Transform (FT) I-path E-traps. The I-path E-traps suffer slow oscillation frequency and very limited space charge capacity. A combination of low oscillation frequencies (under 100 kHz for 1000 amu ions) and low space charge capacity (1E+4 ions per injection) either severely limit an acceptable ion flux or lead to strong space charge effects, such as self-bunching of ion packets and peaks coalescence.

In U.S. Pat. No. 5,886,346, incorporated herein by reference, Makarov suggested electrostatic Orbital Trap with an image charge detector (trade mark 'Orbitrap'). The Orbital Trap is a cylindrical electrostatic trap with a hyper-logarithmic field. Pulsed injected ion packets rotate around the central spindle electrode in order to confine ions in the radial direction, and oscillate in a nearly ideal linear field (quadratic potential distribution) which provides harmonic axial ion oscillations with the period being independent on the ion energy. An image charge detector senses the frequency of ion axial oscillations. The combination of Orbitrap with so-called C-trap (RF linear trap with curved axis and with radial ion ejection) provides a larger space charge capacity (SCC) per single ion injection: SCC=3E+6 ions/injection (Makarov et al, "Performance Evaluation of a High-Field Orbitrap Mass Analyzer" JASMS., v. 20 (2009) #8, pp 1391-1396, incorporated herein by reference). However, the orbital trap suffers slow signal acquisition. The signal acquisition with the image detector takes about 1 second for obtaining spectra with 100,000 resolution at m/z=1000. The slow acquisition speed in combination with space charge limit of the C-trap do limit the duty cycle of mass spectrometer to 0.3% in most unfavorable cases.

Thus, in the attempt of reaching high resolving power, the prior art multi-pass time-of-flight mass spectrometers and electrostatic traps with an image charge detection do limit the accepted ion flux under 1E+7 i/s which limits the effective duty-cycle under 0.3-1% in most unfavorable cases.

It is an object of at least one aspect of the present invention to obviate or mitigate at least one or more of the aforementioned problems.

It is a further object of at least one aspect of the present invention to improve the ion flux throughput and the duty cycle of mass spectrometers with high resolving power in the range of about 100,000.

SUMMARY

The inventor has realized that the novel type of mass spectrometer, herein called 'open electrostatic trap' improves the combination of parameters—resolution, sensitivity and dynamic range—of mass spectrometers compared to prior art E-traps and M-TOF. Similarly to multi-pass TOF, open electrostatic traps (E-traps) employ the same type of analyzer's electrostatic fields, wherein ion packets experience multiple oscillations (reflections between ion mirrors or loop cycles within electrostatic sectors) while traveling from a pulsed source to a detector. Contrary to multi-pass TOF, the E-traps do not employ means for confining ion packets in so-called drift direction (in this application always Z-direction). The ion path between a pulsed ion source and an ion detector becomes composed of an integer number N of ion oscillations, wherein the number N is not fixed, but rather varies within some span ΔN. The spectral decoding employs the prior known information on the ejection timing and on the measured intensity distribution within each multiplet group.

Accounting multiplicity of m/z species, the signal in open E-traps is composed of partially overlapping signals from a range of integer number of reflections N+-ΔN/2, named here as 'multiplets', which creates an additional complication is spectra decoding. On the other hand, spreading of ion packets in the drift Z-direction extends the space charge capacity of analyzers and the dynamic range of detectors. The method allows extending the length and the ejection frequency of pulsed converters and this way substantially increases the duty cycle of the pulsed conversion and, hence, sensitivity of the open electrostatic traps with a non-fixed flight path.

The method is primarily applicable to tandem mass spectrometry and for various forms of tandems with an ion separation prior to MS analysis. Then the spectral content is sparse (usually under 1% of spectral space) which allows reconstructing spectra from multiple overlapping signals. In case of MS-only analysis, the signal decoding is assisted by recording of non overlapping signals on the auxiliary detector, by using upfront time separation, or by chemical noise suppression, like correlated mobility-m/z filtering.

The method is described for several particular pulsed ion sources and pulsed converters like orthogonal accelerators, radiofrequency and electrostatic pulsed ion guides, and radiofrequency ion traps.

The inventor is not aware of any prior art employing the principle of the open trap analysis neither in electrostatic, nor radio-frequency, or magnetic fields. For this reason, the invention may be formulated in the broadest sense as a method of multiplet recording with an open isochronous trap. The short formulation is based on the earlier provided definition of the open ion trap and of the multiplet signals.

According to a first aspect of the invention, there is provided a method of mass spectral analysis comprising the following steps:

(a) passing ion packets through electrostatic, radiofrequency or magnetic fields providing isochronous ion oscillations;

(b) recording time-of-flight spectra corresponding to a span of integer numbers of ion oscillation cycles (multiplets); and (c) reconstructing mass spectra from multiplet containing signals;

wherein the reconstructed mass spectra are capable of being used for mass spectral analysis.

According to a second aspect of the invention, there is provided a method of mass spectral analysis comprising the following steps:

(a) forming ion packets of multiple species from an analyzed sample;

(b) arranging an electrostatic field which provides spatial ion trapping in at least two directions and an isochronous ion motion along a central ion trajectory;

(c) injecting said ion packets for ion passage through said electrostatic field wherein said ion packets are capable of forming multiple ion oscillations;

(d) detecting ions and measuring ion packet flight times (multiplets) at a detection plane for an integer number N of ion cycles within a span ΔN; and (e) reconstructing mass spectra from said detected signals containing multiplets;

wherein the reconstructed mass spectra are capable of being used for mass spectral analysis. The second aspect acknowledges that electrostatic traps are most practical.

Preferably, said electrostatic field may comprise a substantially two-dimensional (2D) electrostatic field in an X-Y plane extended in a locally orthogonal Z-direction. Preferably, said ion injection into said electrostatic field may be arranged at an inclination angle $\alpha$ to axis X to form an average shift in the Z-direction per single oscillation cycle. Alternatively, said electrostatic field may comprise a three-dimensional field. Preferably, to improve resolving power of the method, said ion injection step may be adjusted to provide ion packets time-focusing at a detector plane $X=X_D$. Further preferably, said electrostatic field may be adjusted to sustain time-focusing at the detector plane $X=X_D$.

There are multiple possible structures of said 2D electrostatic field. Preferably, said electrostatic field may comprise at least one field of the group: (i) a reflecting and spatially focusing field of an electrostatic ion mirror; (ii) a deflecting field of electrostatic sector. Preferably, said substantially two-dimensional electrostatic filed may have one symmetry of the group: (i) of planar symmetry, wherein E-trap electrodes are parallel and are linearly extended in the Z-direction; and (ii) of cylindrical symmetry, wherein E-trap electrodes are circular and the fields extends along the circular Z-axis to form torroidal field volumes. The variety of possible field structures may be extended by possible curvature of said X, Y or Z axes, wherein the plane of the axis curvature may be generally tilted relative to the central ion trajectory, as described in a co-pending patent application 'Electrostatic Trap' by the present inventor.

The spectral decoding strongly depends on the number of peaks $\Delta N$ within multiplets. Preferably, the multiplet span may be controlled either by angular and spatial spreads of ion packets at the ion injection step, or by an additional steering and focusing in the Z-direction within said ion trap. Preferably, those parameters may be adjusted such that, at detector region, the ion packets spatial spread in the Z-direction may be larger than the $Z_1$ shift per single ion cycle. Preferably, the angular and spatial spreads of ion packets at ion injection step may be set independent on ion m/z to provide m/z independent intensity distribution within the multiplets, and wherein said intensity distribution within multiplets is determined in calibration experiments to assist the step of mass spectra reconstruction. Alternatively, a time dependent Z-focusing may be employed for varying the span $\Delta N$ Vs ion m/z and this way reducing the number of overlapped peaks. Preferably, said focusing may be alternated between at least two settings, and data may be recorded in at least two synchronized sets in order to assist multiplets decoding.

Multiple other parameters may be adjusted to control the number of oscillations N and the span $\Delta N$ of signals within multiplets, such as open trap length, detector length, and electrostatic trap tuning. Preferably, the number N of ion cycles between ion injection and ion detection may be one of the group: (i) from 3 to 10; (ii) from 10 to 30; (iii) from 30 to 100; and (iv) over 100. Preferably, the number $\Delta N$ of recorded signals within multiplets may be one of the group: (i) 1; (ii) from 2 to 3; (iii) from 3 to 5; (iv) from 5 to 10; (v) from 10 to 20; (vi) from 20 to 50; and (vii) over 100. Preferably, depending on the number of analyzed m/z species, the inclination angle $\alpha$ of ion injection may be adjusted such that to control the multiplet span $\Delta N$ for the purpose of adjusting the relative population of the detector signal being one of the group: (i) from 0.1 to 1%; (ii) from 1 to 5%; (iii) from 5 to 10%; (iv) from 10 to 25%; and (v) from 25 to 50%.

Preferably, in order to control the number of peaks within the multiplets and for the purpose of extending the dynamic range of a detector, said detection step may comprise a step of sampling a portion of ion packets per single ion oscillation cycle for generating multiple multiplet signals per any m/z specie. Preferably, to provide m/z independent intensity distribution between multiplets and to assist the step of mass spectra reconstruction, said portion of sampled ions onto the detector may be set independent on ion m/z, and said multiplet distribution is determined in calibration experiments.

To detect all the injected ions without losses it is advantageous to keep the detector Z-length $Z_D$ larger than the average shift $Z_1$ per single ion cycle. Preferably, the detector may be double sided. Further preferably, the time focal plane of ion packets may be adjusted to match the detector surface by using a decelerating field in front of the detector. Preferably, to assist ion collection onto a detector, an additional steering or weak focusing step may be introduced prior to detection in order to direct majority of ions onto the active detector surface while bypassing the detector rim and the decelerator rim. Preferably, ion detection step may be assisted by ion-to-electron conversion on a surface, wherein such surface may have negligible rims.

Since the signal multiplicity (multiplets) and signal decoding are already incorporated into the method, the method allows other steps which would increase the number of peaks within multiplets while reaching various enhancements of the method. Preferably, the Z-length of the ejected ion packets may be set longer than the average shift $Z_1$ per single ion cycle. This allows improving the duty cycle of a pulsed converter and thus would improve the sensitivity of the method. To further improve sensitivity, the ion injection step may be arranged at shorter period than the flight time of the largest m/z ion specie to a detector. Preferably the incoming ion flow may be modulated into a quasi-continuous flow with time segments matching the duration of the injection pulse string. As an example, the ion flow modulation may comprise steps of ion trapping and pulsed release out of a gaseous radiofrequency ion guide.

In one group of methods, an additional signal may be used to provide any additional information for decoding of spectra containing multiplets. Preferably, spectra may be acquired in at least two alternated sets with various sequences of injection pulses in order to decode multiplets and time shift overlaps. To decode the strongly overlapping spectra, the method may further comprise an additional step of recording flight times at intermediate detector for a fraction of ion packets at much shorter number of oscillations while avoiding multiplets. Preferably, ion packets may be split into two sets traveling in opposite Z-directions towards two detectors. Preferably, the splitting of ion packets may be arranged between a set of bipolar wires. Further preferably, the splitting may be time dependent to adjust inclination angle of ion packets as a function of ion mass to charge ratio. Preferably, an ion packets splitting may be arranged for reverting of the Z-shift direction for a fraction of ion packets, e.g. for rising flight path or for spectral filtering.

The success of signal decoding strongly depends on spectra complexity and the method is primarily suggested for use with tandem mass spectrometry and other ion separation methods like ion mobility and differential ion mobility. Preferably, the method may comprise an additional step of ion time-separation according to their mobility or differential mobility prior to the step of ion pulsed injection into said electrostatic field. Optionally, the mobility separation step may be followed by ion fragmentation. Alternatively, the method may comprise steps of parent m/z separation and a step of ion fragmentation for tandem MS-MS analysis. In a further alternative, the method may comprise additional steps of ion trapping and of crude time-of-flight separation prior to the step of ion injection into said electrostatic field. Such separation spreads multiplet groups and improves the spectral decoding step. Preferably, ion injection into said electrostatic field may be arranged faster than the flight time to a detector of the heaviest m/z ion specie to improve response time of electrostatic trap in the above described tandems. For implementation of IMS-CID-MS and MS-MS methods the acquisition of fragment spectra on high resolution detector may be complimented by acquiring parent spectra on the auxiliary detector while avoiding multiplets.

Preferably, for accelerating the open E-trap analysis, the method further comprises a step of multiplexing said electrostatic field volumes within the same set of electrodes by making a set of aligned slits; and further comprising a step of distributing ion packets into said electrostatic field volumes for parallel and independent mass analysis from either single or multiple ion sources.

In one preferred group of methods, said step of ion injection into said electrostatic field comprises a pulsed orthogonal acceleration of continuous or quasi-continuous ion beams propagating in the Z-direction. Preferably, said pulsed orthogonal field may be adjusted to provide temporal focusing at the detector plane $X=X_D$. Preferably, the number of reflections may be controlled by varying the energy of said ion beam at the entrance of said orthogonally accelerating pulsed field. Preferably, said orthogonally accelerating field region is displaced in the Y-direction, and wherein ion packets are returned onto X-Z plane of central ion trajectory by a pulsed Y-deflection. Alternatively, to avoid interference of the accelerator with the reflected ion packets, the accelerating field may be tilted, the ion packets are steered after the first reflection and both tilting steering angles are chosen to mutually compensate time-of-flight distortions.

Preferably, to enhance sensitivity of the method, the length of said orthogonally accelerating field may be larger than the shift $Z_1$ per single ion cycle. Further preferably, the period between orthogonally accelerating pulses may be shorter than the flight time of the heaviest ion specie to detector for enhancing sensitivity of the analysis. Preferably, said step of orthogonal acceleration is arranged between parallel plates and through a window of one plate. Preferably, said plates may be heated to avoid the formation of non conductive films on surfaces. To maintain long accelerating region without ion beam defocusing, the ion delivery into said of orthogonal acceleration is assisted by a radiofrequency field. Alternatively, to assist ion delivery into the accelerating region, said orthogonal acceleration may be arranged between electrostatic periodic focusing fields of an electrostatic ion guide.

Preferably, to enhance sensitivity, the method further comprises a step of conditioning the ion flow within a gaseous radiofrequency (RF) ion guide prior to the step of orthogonal pulsed acceleration. Preferably, the method may further comprise a step of ion accumulation and pulsed ion extraction out of said RF ion guide, wherein said extraction is synchronized with said orthogonal accelerating pulses.

In one group of methods, said step of ion injection comprises steps of ion trapping in radiofrequency field of an ion trap in the presence of gas. Preferably, said step of ion trapping may occur at gas pressures from about 10 to 1000 Pa. Further preferably, the trapping time may be selected to maintain product of gas pressure and trapping time above about 0.1 Pa*sec in order to arrange an ion collisional damping.

Preferably, the region of said trapping radiofrequency field may be extended substantially either along the Z-axis or along the Y-axis and the ion ejection is arranged through a window in one of trapping electrodes. Alternatively, the ion trapping may be arranged within an array of RF ion guides aligned in the X-direction and assisted by electrostatic well formed with auxiliary electrodes. Preferably, the method of ion pulsed ejection out of the trap may further comprise a step of ion packets splitting and steering by field of bipolar wires located in the first time-focal plane.

The invention is applicable to a wide variety of ionization methods. In one group of methods, said step of ion packet formation may comprise one step of the group: (i) a MALDI ionization; (ii) a DE MALDI ionization; and (iii) a SIMS ionization; (iii) pulsed extraction from a fragmentation cell; and (iv) an electron impact ionization with a pulsed extraction. The method of open ion trap analysis provides an opportunity of determining exact timing of start pulses, even if ion source conditions rapidly vary.

One method further comprises a step of ion packets formation within a pulsed ion source which varies at a time scale comparable to ion flight time in the E-trap. The group further comprises a step of recognizing the time of ion generating pulse by the time pattern within the signal multiplets; and said step of ion packets formation comprises one step of the group: (i) bombardment of an analyzed scanned surface by particle or light pulses; (ii) randomly ionizing aerosol particles; (iii) ionizing a sample outlet of ultra-fast separation device; and (iv) ionizing samples within rapidly multiplexed ion sources.

According to a third aspect of the invention, there is provided an algorithm of decoding multiplet spectra in open isochronous ion traps comprising the following steps:

(a) calibrating the intensity distribution within multiplets I(N) in reference spectra;

(b) detecting peaks in raw spectra and composing a peak list with data on their centroids $T_{OF}$, intensities I, and peak widths dT;

(c) constructing a matrix of candidate flight times per single reflection $t=T_{OF}/N$ corresponding to raw peaks $T_{OF}$ values and to guessed numbers of reflections N;

(d) selecting likely t values corresponding to multiple hits and collecting groups of corresponding $T_{OF}$ values, i.e. hypothetical multiplets;

(e) verifying peaks validity within the group by analyzing distribution of $T_{OF}$ and intensities I(N) within hypothetical multiplets;

(f) checking $T_{OF}$ overlaps between groups, and discarding overlapping peaks;

(g) recovering correct hypotheses of T (normalized flight times) and intensity I(T) using valid peaks of the group; and (h) accounting for number of discarded positions to recover the expected intensities I(T).

The number of oscillations N and its span ΔN may be varied at the stage of setting experimental conditions in the open E-trap thus adjusting parameters N and ΔN within the multiplet signal. Preferably, the number N of ion oscillations may be one of the group: (i) from 3 to 10; (ii) from 10 to 30; (iii) from 30 to 100; and (iv) over 100. Preferably, the span ΔN within multiplet signal may be one of the group: (i) 1; (ii) from 2 to 3; (iii) from 3 to 5; (iv) from 5 to 10; (v) from 10 to 20; (vi) from 20 to 50; and (vii) over 100. Preferably, depending on the number of analyzed m/z species, the multiplet span ΔN is adjusted for the purpose of adjusting the relative population of the signal being one of the group: (i) from 0.1 to 1%; (ii) from 1 to 5%; (iii) from 5 to 10%; (iv) from 10 to 25%; and (v) from 25 to 50%.

According to a fourth aspect of the invention there is provided an isochronous open ion trap mass spectrometer with multiplet spectra acquisition.

The formulation relies on the earlier provided definition of the open ion trap and of multiplet spectra. The ion trap may be electrostatic, radiofrequency, or magnetic. It is however recognized that electrostatic traps are most practical.

According to a fifth aspect of the invention, there is provided an electrostatic open trap mass spectrometer (E-trap) comprising:

(a) ionization means to form ion species from neutral species of an analyzed sample;

(b) a pulsed ion source or a pulsed converter to form ion packets from said ions;

(c) a set of electrostatic trap electrodes substantially extended along a Z-direction to form a substantially two-dimensional electrostatic field in a locally orthogonal X-Y plane;

(d) the shape of said trap electrodes and their potentials are adjusted to provide cyclic ion oscillations and a spatial confinement of said ion packets in said X-Y plane, as well as an isochronous ion motion along a central ion trajectory;

(e) said pulsed ion source or pulsed converter is arranged to inject ion packets at an inclination angle $\alpha$ to the X-axis for ion passage through said electrostatic field while forming multiple oscillations within said X-Y plane and an average shift $Z_1$ along the Z-direction per single ion oscillation;

(f) a detector located at $X=X_D$ plane for measuring ion packets flight times after an integer number N of ion oscillations, varying within some span $\Delta N$, and thus forming signal 'multiplets' for any m/z ion specie; and (g) means for reconstructing mass spectra from detector signal containing multiplets.

The disclosed open electrostatic trap may be implemented with a variety of electrode sets. Preferably, said electrostatic trap electrodes comprises one electrode set of the group: (i) at least two electrostatic ion mirrors; (ii) at least two electrostatic deflecting sectors; (iii) at least one ion mirror and at least one electrostatic sector. Preferably, said substantially two-dimensional electrostatic filed may have one symmetry of the group: (i) of planar symmetry, wherein E-trap electrodes are parallel and are linearly extended in the Z-direction; and (ii) of cylindrical symmetry, wherein E-trap electrodes are circular and the field extends along a circular Z-axis to form torroidal field volumes. Preferably, said X, Y or Z axes may be generally curved. In one particular embodiment, said E-trap may be formed of two parallel ion mirrors, spaced by a field-free space, and wherein said mirrors are wrapped into torroid along a circular Z-axis. In another particular embodiment, said E-trap further comprises at least one electrostatic sector being wrapped into torroid along a circular Z-axis. The most preferred analyzer embodiment comprises two parallel torroidal ion mirrors separated by a field-free space. The torroidal embodiments provide a compact analyzer spatial folding while maintaining large Z-perimeter. Preferably, each of said ion mirrors may comprise at least one accelerating lens and at least four electrodes for providing spatial ion focusing, at least second order spatial and angular isochronicity and at least third-order energy isochronicity.

One embodiment comprises spatial focusing means located between said pulsed converter and said detector for controlling the ion packet Z-divergence and the number of peaks $\Delta N$ within multiplets. Preferably, said spatial focusing means may be attached to a generator with a time variable signal in order to control the number of multiplets versus ion m/z. Alternatively, the constant electrostatic focusing may be used for providing m/z independent intensity distribution within multiplets. Preferably, the embodiment may further comprise the ion packets steering means located between said pulsed converter and said ion detection. The steering would allow controlling the inclination angle and thus controlling numbers N and $\Delta N$ within multiplets.

A group of embodiments aim the sensitivity enhancement by optimizing the detector. In one embodiment, the detector Z-length may be larger than the average shift $Z_1$ per single ion cycle. Preferably, the detector may be double-sided and wherein the time focal plane is adjusted to match the detector surface by decelerating field in-front of the detector. Preferably, the embodiment may further comprise steering and focusing means in-front of said detector in order to direct majority of ions onto the active detector surface while bypassing the detector rim and the optional decelerator rim. Preferably, one embodiment further comprises an ion-to-electron converter sampling a portion of ion packets per single ion cycle; wherein secondary electrons are sampled onto from both sides of said ion converter; and wherein the converter comprises a decelerator for matching the time focal plane with the converter surface plane.

Multiple embodiments disclose a variety of pulsed ion sources or pulsed converters. In one group of embodiments, said pulsed ion source comprises one of the group: (i) a MALDI source; (ii) a DE MALDI source; and (iii) a SIMS source; (iii) a fragmentation cell with a pulsed extraction; (iv) an electron impact source with a pulsed extraction. In one embodiment, for the purpose of rapid surface analysis, said pulsed ion source comprises bombardment of an analyzed surface by particle or light pulses with bombarded spot being scanned on the analyzed surface. Preferably, the period between bombarding pulses may be set much shorter than flight time of the heaviest ion specie. Preferably, time of ion generating pulse is then recognized using time pattern within the signal multiplets.

In another group of embodiments, said pulsed converter comprises an orthogonal accelerator for converting a continuous or quasi-continuous ion beam propagating substantially along the Z-direction into ion packets accelerated substantially along the X-direction. Preferably, said orthogonal accelerator may comprise parallel plate electrodes with a slit for ion extraction. Alternatively, said converter comprises RF ion guide at either gaseous conditions for ion dampening and optionally, for ion accumulation. Yet alternatively, said pulsed converter may comprise an RF ion guide at vacuum conditions communicating ions with an upfront gaseous RF ion guide. Yet alternatively, the orthogonal accelerator may comprise an electrostatic ion guide for ion radial confinement. Preferably, the ion energy of said continuous or quasi-continuous ion beam may be controlled to adjust the number of ion reflections in said E-trap. Preferably, said orthogonally accelerator may be displaced in the Y-direction compared to the X-Z plane of central ion trajectory and a set of pulsed deflectors then return ion packets onto the central plane. The arrangement prevents ions hitting the accelerator after being reflected within the E-trap. Alternatively, the orthogonal accelerator may be set at a small inclination angle $\alpha$ to the Z-axis and ions are steered after first reflection in the E-trap analyzer such that to provide mutual compensation of time-of-flight aberrations caused by the tilt and the steering. Preferably, the angles of tilt and steering account the ion trajectory inclination angle caused by finite energy of continuous ion beam in cases of plate accelerator or electrostatic ion guide accelerator or a nearly zero ion energy in case of a gaseous RF ion trap. The arrangement would provide a wider Z-spacing between the orthogonal accelerator and the steering device, while reducing the ion trajectory inclination angle within the E-trap analyzer for a compact trajectory folding.

One group of embodiments discloses improvement of orthogonal accelerator for increase of E-trap sensitivity. Preferably, the Z-length of said ion source or pulsed converter may be longer than the average shift $Z_1$ per single ion cycle.

Complimentary, said pulsed source or pulsed converter is energized at shorter period than the flight time of the heaviest m/z ion specie to the detector. Preferably, the orthogonal accelerator may be combined with an upfront RF gaseous ion guide. Further preferably, said guide may accumulate and release ions in a form of quasi-continuous ion beam. Further preferably, the propulsion of said quasi-continuous ion beam may be synchronized with frequent orthogonal pulses with much shorter period than the flight time of the heaviest m/z ions in the E-trap. Further preferably, spectra may be acquired for the sufficiently long duration to detect the collection of ions injected by said pulse string.

The invention is primarily applicable to tandem mass spectrometry wherein mass spectra are sparse by nature. One embodiment further comprises at least one parent ion separator of the group: (i) a mass-to-charge separator; (ii) an ion mobility separator; (iii) a differential ion mobility separator; and (iv) any of the above ion separators followed by a fragmentation cell. Alternatively, for improving spectra decoding, the embodiment may further comprise an RF ion trap and a crude time-of-flight separator or an ion mobility separator prior to the orthogonal accelerator. The separator improves multiplet separation in open E-trap spectra. Preferably, the period between ion injections into said E-trap may be arranged faster than the flight time to a detector of the heaviest m/z ion specie in order to improve E-trap sensitivity and spectra decoding.

BRIEF DESCRIPTION OF THE DRAWINGS

Various embodiments of the present invention together with arrangements giving illustrative purposes only will now be described, by way of example only, and with reference to the accompanying drawings in which:

FIG. 5 shows ion trajectories in the vicinity of the detector and shows detector embodiments with spatial ion focusing and with ion deceleration;

DETAILED DESCRIPTION

Prototypes

Figure 1:
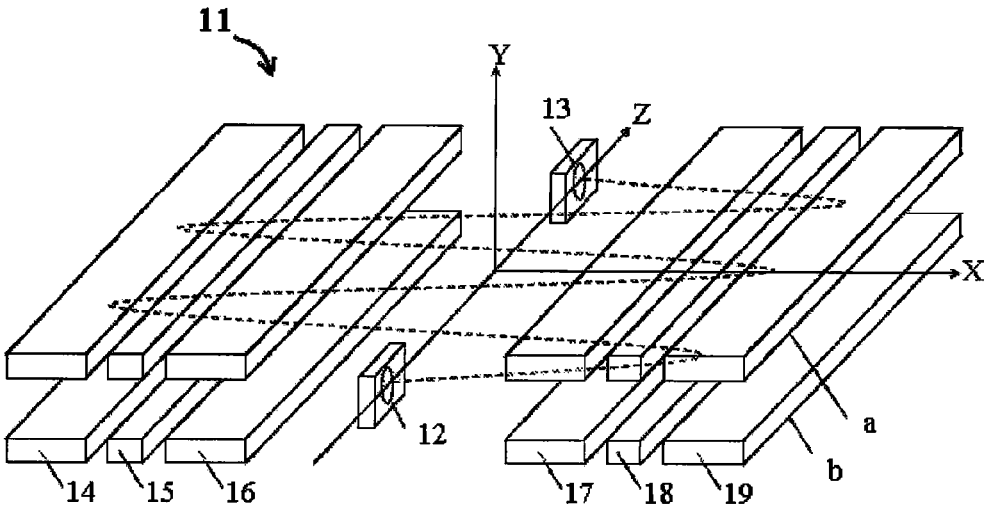
FIG. 1 PRIOR ART
FIG. 1 depicts a prior art planar multi-reflecting mass spectrometer (MR-TOF) with a fixed flight path between an ion source and a detector.

Referring to FIG. 1, the prior art SU 1,725,289, incorporated herein by reference, planar MR-TOF 11 comprises a pulsed ion source 12, a fast response detector 13 and two parallel planar and gridless ion mirrors composed bar electrodes 14 to 19.

In operation, electrostatic gridless ion mirrors reflect ion packets in the X-direction, while providing spatial ion focusing in the Y-direction, as well as isochronous ion oscillations in the X-direction. The pulsed ion source 12 generates ion packets with a very low divergence and directs the ion packets at an inclination angle to the X-axis. Ion packets get reflected between ion mirrors while shifting in the Z-direction, this way forming jig-saw ion trajectories until they hit the detector 13. The flight path along the jigsaw trajectory is extended compared to singly reflecting TOF spectrometers for the purpose of increasing the resolving power (resolution). The prior art assumes the ion packets to be low diverging and the number of reflections is expected to be limited to very few in order to avoid ion packet spreading in the Z-direction and to ensure a fixed number of reflections.

Figure 2:
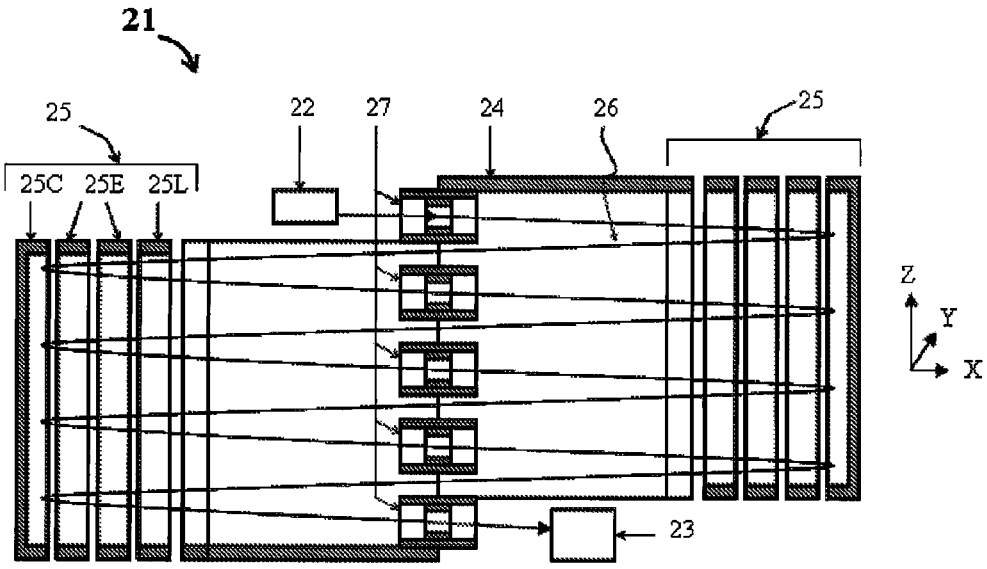
FIG. 2 PRIOR ART
FIG. 2 depicts prior art planar MR-TOF with a set of periodic lenses to ensure a long and constant ion path for diverging ion packets.

Referring to FIG. 2, the prior art GB 2,403,063 and U.S. Pat. No. 5,017,780, incorporated herein by reference, planar MR-TOF 21 comprises a pulsed ion source 22, a fast response (TOF-type) detector 23, two parallel planar gridless ion mirrors 25 separated by a field-free space 24, and a set of periodic lenses 27. Each ion mirror is composed of at least four rectangular electrodes substantially elongated in the Z-direction.

In operation, the pulsed ion source (or pulsed converter) 22 generates ion packets and sends them along the jigsaw trajectory 26 towards the detector 23. Ions are reflected by ion mirrors 25 in the X-direction while slowly drifting in the Z-direction. Ion mirrors are optimized to provide spatial focusing in the Y-direction, as well as high order isochronous properties regarding initial spatial, angular, and energy spreads. The set of periodic lenses 27 confines the packet spreading in the Z-direction and enforces the ion confinement along the predetermined jigsaw ion path. The number of reflections could be increased to many tens at small packet divergence. The number of reflections is limited by the instrument size and by the angular acceptance of the MR-TOF.

The down side of the prior art of FIG. 2 is in small spatial and angular acceptance of the analyzer which limits the efficiency of pulsed converters. For example, if using a well known orthogonal ion injection, the length of the orthogonal accelerator should be less than 10 mm while typical pulse period is 1 ms. Then the duty cycle of the accelerator is under 1%, which limits the instrument sensitivity. The confinement of ion packets within few mm size leads to space charge distortions in spectra once ion packets contain more than 1000 ions per shot. Thus, maximal handled ion flux is less than 1E+6 ions per second per mass specie. This is substantially lower than can be generated by modern ion sources:

1E+9 ions/sec in case of Electrospray (ESI), APPI and APCI; 1E+10 in case of EI and glow discharge (GD); and 1E+11 in case of ICP ion sources.

It is an object of the present invention to increase the acceptance and the space charge throughput of mass spectrometric analysis. This object is reached by arranging the analyzer and the detector such that to detect ions from a variety of widely overlapping cyclic trajectories and by providing a method of recovering mass spectra from signals originating from variable number of reflections, called multiplets.

Open E-Traps with Multiplets

The open electrostatic trap of the invention may be formed with a large variety of the analyzer topology and with various types of analyzer subunits such as ion mirrors, electrostatic sectors, field free spaces, deflectors as shown below in FIG. 15. For clarity, the core of the description will be teaching the open trap method and apparatus using an example of planar multi-reflecting analyzer.

Figure 3:
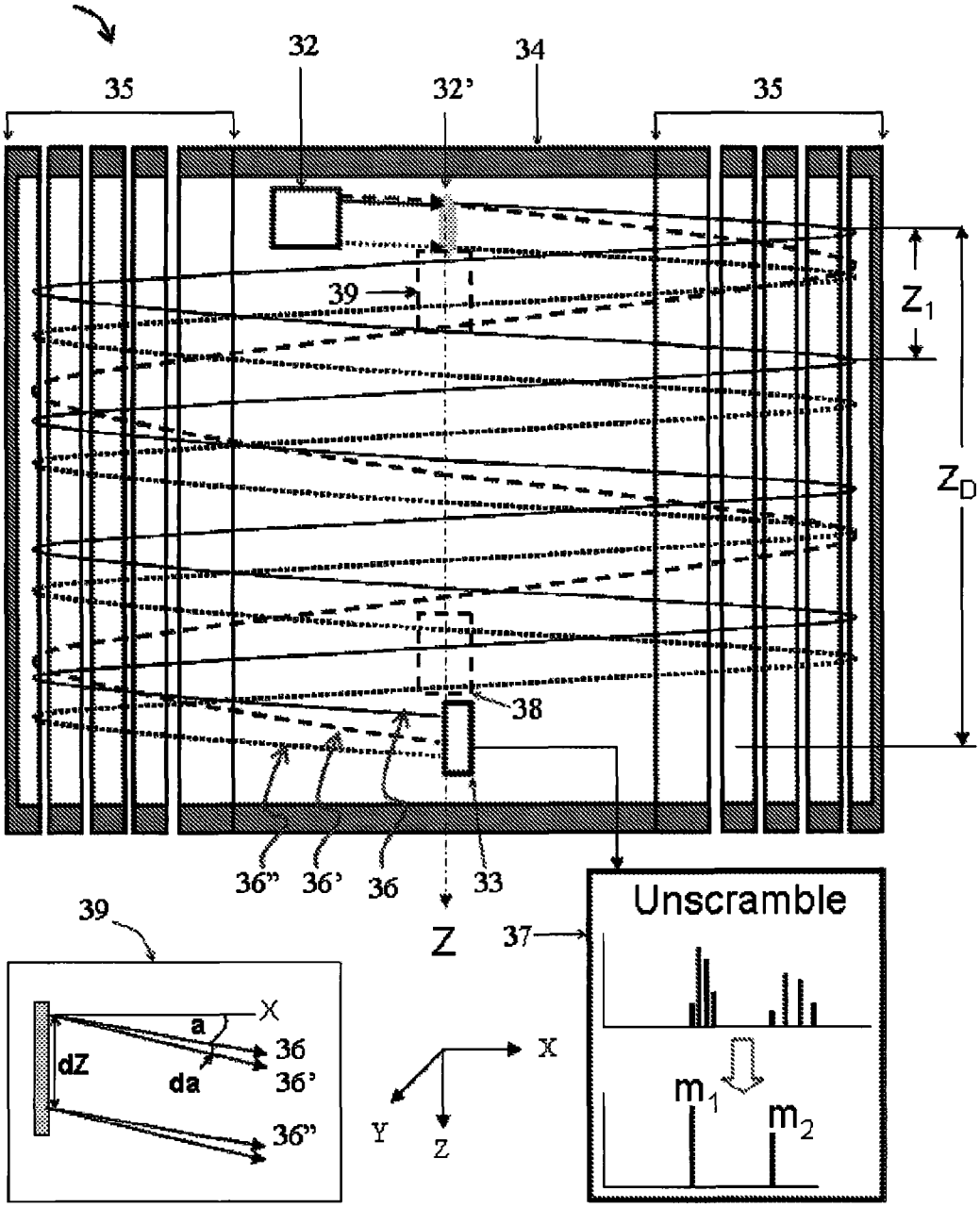
FIG. 3 illustrates the method of the invention where ion packets pass through an open E-trap and form signal multiplets due to span in ion oscillation cycles.

Referring to FIG. 3, one preferred embodiment 31 of the open electrostatic trap (E-trap) mass spectrometer of the present invention comprises a pulsed ion source 32, a fast response detector 33 with decoding means 37, a pair of planar gridless ion mirrors 35 separated by a drift space 34. Optionally, the preferred embodiment comprises focusing and steering means 38 between the pulsed source 32 and the detector 33. Optionally, the preferred embodiment comprises a single long-focusing lens 39 in the path between the ion source 32 and the detector 33.

In operation, and for the purpose of illustrating the general method of the invention, the ion mirrors are arranged similarly to prior art MR-TOF. Two planar gridless ion mirrors are aligned parallel and are spaced by a field-free region. Mirrors are set symmetric relative to the symmetry X- Y- and Z-axes. Each mirror is composed of at least 4 electrodes with a rectangular shape windows and substantially elongated in the Z-direction such that to form substantially two-dimensional electrostatic field. Preferably, each mirror comprises an attracting lens. Similarly to prior art, the field in the ion mirrors is adjusted to provide spatial ion focusing in the Y-direction and isochronous properties with respect to ion energy in the X-direction, to spatial and angular beam divergences in the Y-direction, and compensation of cross-term aberrations to at least second order of the Tailor expansion, so as time-to-energy focusing to at least third order.

Ion packets 32' are pulsed injected from the pulsed source 32 into the drift space 34 at an average angle $\alpha$ to the X-axis and follow the jigsaw trajectories presented by characteristic trajectories 36, 36' and 36" lying within the X-Z middle plane. After a number of reflections ions get onto the fast response (TOF type) detector 33, typically microchannel plate (MCP) or secondary electron multiplier (SEM). The pulsed source 32 is arranged such that to provide intermediate time focusing at the symmetry Z-axis, so as the mirrors 35 are tuned such that to provide time focusing every time the ions cross the symmetry Z-axis. Note, that it is viable shifting detector X-Z plane with $X=X_D$ anywhere within the field-free space while not posing any additional limit onto the method or apparatus. The source emittance $dZ*d\alpha$, i.e. the product of initial spatial dZ and angular $d\alpha$ spreads, is large enough to cause uncertainty $\Delta N$ in the number N of ion reflections between the pulsed source 32 and the detector 33. The assumed large emittance of the ion source is also illustrated by the icon 39 showing the Z-size of the pulsed source 32 and ion injection vectors 36, 36' and 36". As a result, ions will follow trajectories with the average number of reflections N and with the $\Delta N$ span, i.e. spread in the number of reflections. The figure shows exemplar trajectories 36, 36' and 36" with 4 and 6 mirror reflections, though it is apparent that all possible trajectories would compose a sequence of integer number of reflections, here of 4, 5 and 6 reflections. The analyzer does not discriminate against any particular number of reflections. Any single ion specie will induce a multiplet signal containing $\Delta N$ number of peaks per any m/z ion specie. The assembly of such peaks per single ion m/z specie is named 'multiplet'. Flight times of every ion specie along the ion trajectory with N ion reflections may be presented as $T_{OF}=Ts+NT$, where Ts is the flight time from the ion source to the intermediate focusing plane 32' and T is the flight time per single reflection. Obviously, signals from various trajectories create an assembly of integer number of reflections (multiplet) and, as discussed below, potentially may be decoded to recover either frequency spectra or time-of-flight spectra corresponding to a fixed number of reflections and then can be calibrated as mass spectra. The number of peaks $\Delta N$ within multiplets can be controlled e.g. by adjusting parameters of the source 32 or by focusing lens 39.

One well described approach of analyzing repetitive signals employs the Fourier transformation. However, the straight forward Fourier analysis would provide low precision and would generate higher harmonics in frequency spectra.

Figures 4A, 4B, 4C:
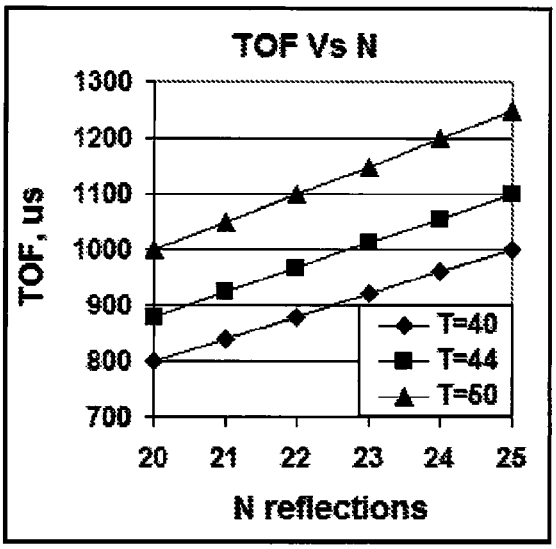
FIG. 4 presents flight times for multiplets in a calculation example and illustrates the principle of multiplet signal decoding; bold font in the table corresponds to repetitively calculated flight times per single reflection (hits of a group)

Referring to FIG. 4, one exemplar spectral decoding strategy of the present invention is presented using a model calculation. The table in FIG. 4A presents model flight times $T_{OF}=T*N$ corresponding to three exemplar flight times T per single reflection equal to 40, 44, and 50 us (in columns) and to the number of reflections N from 20 to 25 (in rows). Peak list with $T_{OF}$ values represents the raw multiplet spectrum. Flight times $T_{OF}$ versus N and as a function of T are also plotted on the graph in FIG. 4B.

Referring to FIG. 4C, there is presented an exemplar decoding matrix. The cells correspond to t hypotheses of flight time per one reflection corresponding to every spectral $T_{OF}$ value (in rows) and to a guessed number N of reflections (in columns). By gathering coinciding t-hypotheses we find that t=40, 44 and 50 appear 6 times in the table while other hypotheses get single hits. This allows filtering out wrong hypotheses. Also note that $T_{OF}$=880, 1000 and 1100 us get two hits, but less hits than the expected $\Delta N$ in multiplets (here 6). This allows filtering out the overlapping peaks, i.e. the $T_{OF}$ values relating to various T. An additional filtering may be assisted by analyzing intensity and centroid distributions within multiplets (step of group validity).

Generalizing the exemplar calculation, one spectral decoding algorithm of the present invention comprises the following steps: (a) injecting a reference sample and calibrating the intensity distribution within multiplets I(N); (b) for the analyzed sample, recording raw (encoded) spectrum with multiplets; (c) detecting peaks in the raw spectrum and composing a peak list with data on their centroids $T_{OF}$, intensities I, and peak widths dT; (d) building a matrix of candidate flight times per single reflection $t=T_{OF}/N$ corresponding to raw peaks $T_{OF}$ values in rows and to guessed numbers of reflections N in columns; (e) picking likely t corresponding to multiple hits and gathering groups of corresponding $T_{OF}$ values, i.e. hypothetic multiplets; (f) verifying peaks validity within the group by analyzing distribution of $T_{OF}$ and intensities I(N) within hypothetic multiplets; (g) checking $T_{OF}$ overlaps between groups, and in the simplest algorithm discarding overlapping peaks; (g) recovering correct hypotheses of T (normalized flight times) and intensity I(T) using valid peaks of the group; and (h) accounting for number of discarded positions to recover the expected intensities I(T).

Obviously, the above exemplar algorithm can be modified in many ways: by analyzing abnormally wide, abnormally displaced, or abnormally intensive peaks; using deconvolution of partially resolved overlapping peaks; treating groups probabilistic, etc. The principle points are: (a) the information for recovering mass spectra is there; and (b) the decoding algorithm would succeed as long as the relative peak population in raw multiplet spectra is relatively low—the estimated upper limit for decoding is 30-50%.

Preferably, accounting the non-fixed ion trajectory, the detector is modified Vs conventional TOF MS. Referring to FIG. 5A, for the purpose of enhancing the E-trap sensitivity, one preferred embodiment of the E-trap mass spectrometer of the invention comprises a detector which is longer than an average ion shift $Z_1$ per single ion reflection. Preferably, the detector is located on the X-Z symmetry axis of the E-trap analyzer. Preferably, the detector is double-sided to detect ions coming from both sides.

Referring to FIG. 5B, one particular detector comprises two sets of chevron configured microchannel plates (MCP) on both sides of a collector. Alternatively, the detector comprises an ion-to-electron conversion surface equipped with a side detector collecting secondary electrons. The converter may be partially transparent for collecting a portion of ion packets per single oscillation. Such approach is useful for extending the dynamic range of fast (nanoseconds) TOF detectors.

In operation, in spite of moderate angular divergence of ion packets, the trajectories of arriving ions may be considered almost parallel in the vicinity of the detector. Ions may hit the detector or converter from both sides. Assuming proper tuning of the pulsed source and of the E-trap, the ion packets are time-of-flight focused at the Z-axis. In the MR-TOF technology it is known that several cross-term aberrations are compensated at every second turn. Then one side of the detector would be providing spectra with higher resolution, which should be accounted at spectral decoding.

The illustration stresses two problems of the detection: (a) ions would be lost at a detector rim; and (b) the finite thickness of detector would cause mismatch of the surface position with time-focal planes. In the exemplar calculation, the detector thickness=3 mm and the ion energy spread=3%. The mismatch between focal and detector planes would cause about 0.1 mm spreading of ion packets. For typical 20 m flight path in the E-trap this would limit the time resolution to 200,000 and the mass resolution to 100,000. For higher resolution it is preferable compensating such time spreads.

Referring to FIG. 5C, the problem of planes mismatch can be solved by using ion beam decelerator 53 in-front of the detector or converter. As an example, a 30 mm long deceleration with 20% energy drop would elongate the effective flight path by 3 mm, which is sufficient to compensate for the detector thickness. The mismatch may be also reduced if using a thin plate converter. To avoid ion losses on the detector rim there are suggested focusing or steering means 52 in the path between the ion source and the detector. The particular shown example shows a deflection set which displaces ions which otherwise would hit the detector rim. Alternatively, a long focusing lens has width of $Z_1$, i.e. equal to single period displacement. Such lens is located several periods upstream of the detector. Long focusing lens would have minor effect onto time-of-flight resolution but would allow using small detectors and would reduce ion losses on rims. Note that ions are expected to arrive to the lens with some spread ΔN in number of reflections, i.e. the weak lens does not affect the multiplet principle of signal recording.

Open E-Trap with Orthoginal Accelerator

Figure 6A:
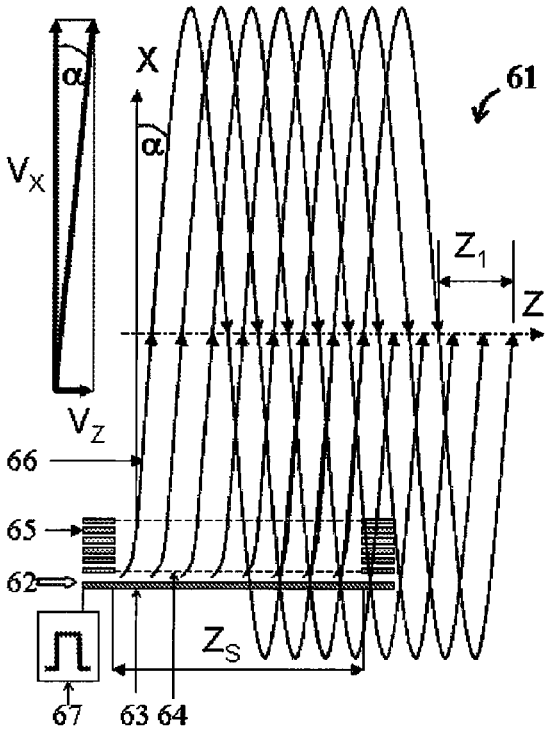
FIG. 6 shows an X-Z cut of E-trap with an orthogonal accelerator and illustrates a method of clearing ion path by the accelerator tilt followed by ion steering.

Referring to FIG. 6A, one preferred embodiment 61 of the E-trap mass spectrometer comprises an elongated pulsed converter with a length Zs longer than an average ion displacement $Z_1$ per single ion reflection. One particular pulsed converter is an orthogonal accelerator which comprises an electrostatic acceleration stage 65, and a pair of electrodes 63 and 64, connected to a pulse generator 67.

In operation, a continuous or quasi-continuous ion beam is fed substantially along the Z-axis. The beam is accelerated to a potential $U_Z$. Once the beam fills the gap between parallel electrodes 63 and 64, an extraction pulse is applied to accelerate ions orthogonally (i.e. in the X-direction) and through the mesh or a slit of the electrode 64. After passing the electrostatic acceleration stage 65 ions are accelerated by the potential $U_X$. Ion trajectories 66 are naturally tilted at an inclination angle $\alpha=\mathrm{sqrt}(U_Z/U_X)$, i.e. the inclination angle may be adjusted e.g. by changing the energy of the continuous ion beam or by tilting the orthogonal accelerator relative to Z axis with subsequent ion packet steering past the accelerator. Such combination provides mutual compensation of tilting and steering effects onto the time spread of ion packets.

The duty cycle of the orthogonal accelerator, i.e. conversion efficiency from continuous ion beam 62 into ion packets, depends on the length of the accelerator $Z_S$, ion energy $U_Z$ and on the pulse period $T_S$. In prior art MR-TOF the duty cycle of 10 mm long accelerator is less than 1%. In the present invention the accelerator length is may be at least 5-10 times longer with proportional increase of the duty cycle.

Elongation of the source does introduce a variation of the Z-distance between the source and detector and hence causes an additional spread ΔN in the number N of reflections (i.e. forms multiplets on its own). However, such additional spread of multiplets is no longer an obstacle since the detector already records wide multiplets (due to angular spread of ion packets), and an additional spread of the multiplet distribution due to the source elongation does not affect the open electrostatic trap operating principles, but it gains multiple advantages such as an increased efficiency and improved space charge capacity of the pulsed source, spreading of ion packets in space and thus increasing the space charge capacity of the analyzer, so as improving the detector dynamic range due to splitting strong signals into multiplets.

As described in the co-pending application "Ion Trap Mass Spectrometer", the orthogonal accelerator may use spatial transverse ion confinement in Z- and Y-directions within the accelerator, either by RF field of an RF ion guide or by periodic electrostatic focusing of an electrostatic ion guide. Preferably, the transverse confining field is switched off prior to ion orthogonal acceleration. The transverse ion confinement allows extending the accelerator Z-length without adding divergence or spatial spread of the continuous ion beam. It also allows reducing the ion energy in the Z-direction and this way improving the duty cycle of the accelerator.

Figure 7:
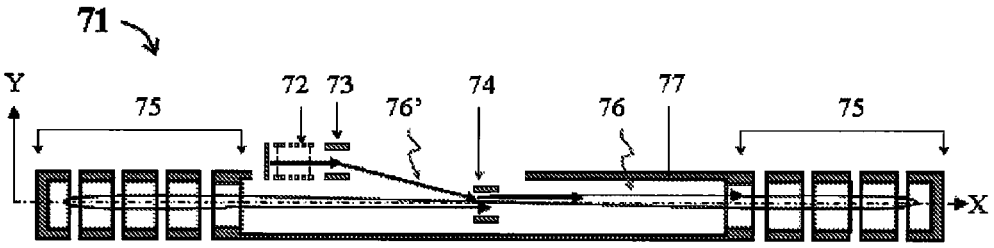
FIG. 7 shows a an X-Y cut of E-trap with orthogonal accelerator and illustrates a method of clearing ion path by accelerator Y-displacement followed by pulsed steering.

Referring to FIG. 7, in order to avoid the spatial interference between the pulsed ion source 72 and ion trajectories, the pulsed source 72 is displaced in the Y-direction and is equipped with two sets of deflection plates 73 and 74 to return ion packets onto the middle plane X-Z (i.e. symmetry axis X in the drawing). Pulsed deflectors stay on till the heaviest ion specie passes the deflector 74. Ions are steered by deflector 73 to follow the tilted trajectory 76' and then are pulsed steered back by the deflector 74 to follow the trajectory 76. The lightest ion species may be reflected by the mirror 75 and would arrive back to the deflector 74 too early. To ensure sufficient m/z range (above 80:1), the ion path 76' may be 8-10 times shorter than the path per single ion reflection, e.g.

for 1 m long analyzer the path 76' should stay in 10-12 cm range. Then the trajectory 77 should be tilted by approximately 8-10 degrees to provide 15 mm Y displacement. The time distortion of such double steering is compensated to the first order, and for dY=1 mm beam thickness, the beam spatial spreading is estimated as 0.01 mm which will not limit resolution of the instrument up to 1E+6 at 20 m flight path.

Figure 6B:
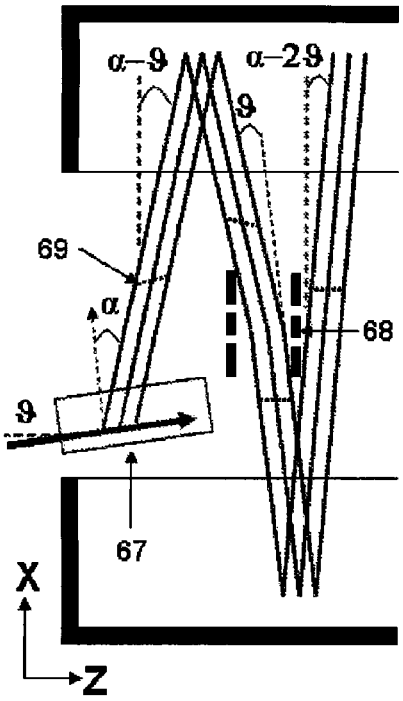

Referring to FIG. 6B, alternatively, to avoid interference of the accelerator with the reflected ion packets, the accelerator 67 is tilted to Z axis at the angle θ, and after first ion reflection, the packets are steered by a deflector 68 for angle θ. The equal angle tilt and steering mutually compensate time distortions. One can see that the time front (shown by dashed line) becomes aligned in parallel to the Z-axis. The resultant trajectory angle becomes $\alpha-2\theta$, wherein a is the inclination angle of ion packets relative to the accelerator axis $\alpha=\mathrm{sqrt}(E_X/E_Z)$. Preferably, the middle plates of the deflector 68 are biased to adjust the strength of spatial focusing. Compared to conventional non tilted orthogonal accelerator, the arrangement of FIG. 6B does extend the space available for the accelerator while keeping small inclination angles of ion trajectories in the E-trap. The arrangement also reduces the ion packets angular divergence in the Z-direction caused by the axial energy spread of the continuous ion beam, since the ion divergence angle $\Delta\alpha=\Delta E_Z/2\alpha*E_X$ drops at larger axial energies $E_Z$ and at corresponding larger initial inclination angles $\alpha=\mathrm{sqrt}(E_Z/E_X)$ past the accelerator. Though, compared to the arrangement of FIG. 7, the arrangement of FIG. 6B does limit the accelerator Z-length, but it does not pose any limitation on the mass range and onto the pulsing frequency of the accelerator 67.

Open E-Trap with Frequent Pulsing

Preferably, the source is operated at much shorter pulse period versus the flight time of the heaviest ion specie. Rising the pulse frequency would proportionally increase the efficiency (duty cycle) of the pulsed converter, the space charge capacity of the converter and of the open E-trap analyzer, the dynamic range of the detector, and the response speed of the open E-trap. However, such frequent source pulsing leads to a higher complexity of raw spectra. Single multiplet spectrum gets shifted in time and raw spectrum would contain a sum of time-shifted multiplets. For clarity, let us separate effects of fast pulsing and of multiplet formation.

Figure 8A:
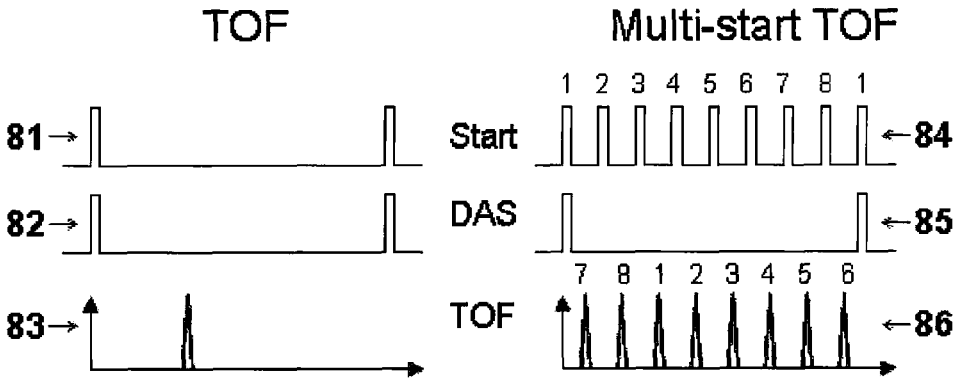
FIG. 8 illustrates appearance of multiple signal peaks due to multiplet formation and due to frequent pulsing of an accelerator.

Referring to FIG. 8A, the principle of frequent start pulsing is illustrated for the case of conventional time-of-flight (TOF) mass spectrometer. The left set of graphs 81-83 corresponds to a single start pulse 81 per waveform acquisition being triggered by data acquisition (DAS) pulses 82. Then TOF signal 83 would have one peak per m/z component. The multi-start TOF case is presented by a right set of graphs 84-86, where eight start signals in diagram 84 are applied per single waveform acquisition 85. Each start signal injects ions into the TOF spectrometer and eight corresponding peaks appear in the TOF spectrum 86. Because of periodic repetition of the shown time cycle, the later two signals would appear in the next cycle, which is illustrated by start and peak numbers. After summation of multiple cycles, the exemplar summed spectrum 86 would have peaks #7 and #8 in the beginning of the spectrum.

Figure 8B:
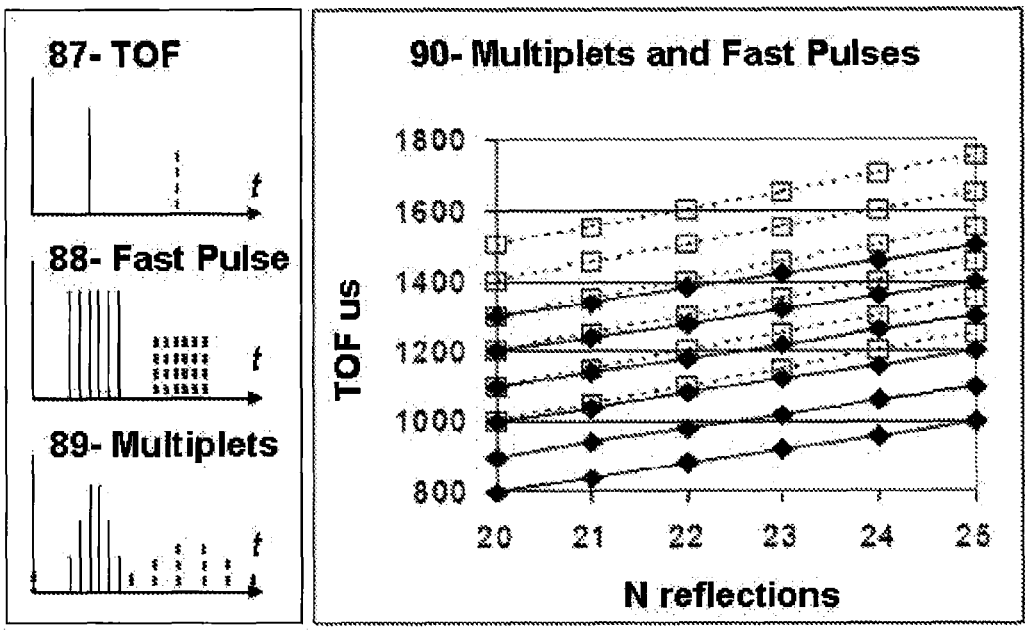

Referring to FIG. 8B, the spectra view and peaks timing are shown for a case of open E-trap with frequent source pulsing. For clarity, effects of multiplets and of frequent pulsing are separated, and three hypothetic spectra illustrate cases of TOF spectra 87, TOF spectra with frequent start pulses 88, and E-trap spectra 89 with multiplets. In all spectra the peaks are coded by solid and dashed lines to distinguish two m/z components. In TOF spectrum 87, the flight path is fixed, i.e. the number of reflections is constant (N=const). Flight times are defined as $T_{OF}=N*T(m/z)$, wherein N=const, and T—is the m/z dependent flight time per single reflection. In case of frequent source pulsing, the TOF spectrum 88 contains multiple peaks with flight times $T_{OF}=N*T(m/z)+\Delta T*s$, wherein N=const, ΔT—is the interval between start pulses and s—is the pulse number in the pulse string varying from 0 to 5. In E-trap spectrum 89, each mass component is presented by exemplar multiplet formed of six peaks, i.e. ΔN=6. The intensity distribution within multiplet series is shown m/z independent. Flight times are defined as $T_{OF}=N*T(mz)$, where N varies from 20 to 25.

In open E-trap with frequent pulsing, the peaks multiplicity is caused by both—multiplet formation and by fast pulsing. The plot 90 presents flight times versus number of reflections N described as $T_{OF}=N*T(m/z)+\Delta T*s$, where N varies from 20 to 25, T=44 us (solid line and dark diamonds) and T=50 us (dashed line and light squares) for two m/z components, ΔT=100 us and s varies from 0 to 5. In the plot 90 the two m/z components form spot patterns with different tilt angles. As a result, peak overlaps may occur at some random flight times but would be avoided at other flight times. Hence, such spectra could be decoded to extract the information on T for both mass components.

Fast pulsing is known in the prior art TOF MS. Let us show the difference of the coding-decoding method of the present invention compared to prior art. In a TOF MS with the Hadamard transformation U.S. Pat. No. 6,300,626, incorporated herein by reference, a pulsed ion source is operated in a quasi-random sequence at high repetition rate. The method employs a regular sequence of start pulses with binary coded omissions, and thus formed overlapped spectra are reconstructed using the information on the known pulse sequence. The method employs automatic (mathematically defined) subtraction of peaks appearing at wrong position. Since peaks intensity naturally fluctuates from start to start the subtraction would generate an additional noise. Contrary to Hadamard TOF MS, the method of the present invention does not generate additional noise, since overlapping peaks are discarded. In WO 2008,087,389, incorporated herein by reference, it is suggested to pulse an orthogonal accelerator faster than the flight time of the heaviest ion specie in a TOF analyzer and to record short spectra corresponding to the period between start pulses. To find overlapping peaks the pulse period is varied between settings. Acceleration of pulse frequency requires proportional increase of the shift number. Contrary to WO 2008,087,389, in the present invention there is no need for frequency variations. Also, recording of long spectra corresponding to the start pulse string improves spectral decoding.

The combination of multiplets with the frequent pulsing leads to a much more complicated raw spectrum like 90, but provides multiple enhancements of MS analysis:

(1) Both, elongation of the orthogonal accelerator and fast pulsing improve the duty cycle, the dynamic range of E-trap, the space charge capacity of E-trap, and the dynamic range of the detector—all proportionally to the gain factor G=ΔN*s, i.e. proportionally to multiplication of the peak number;

(2) Open E-trap accepts a wider angular divergence of ion packets and this way improves efficiency of pulsed converters proportionally to factor ΔN;

(3) Open E-trap does not employ periodic lens and improves time-of-flight aberrations compared to prior art MR-TOF; the advantage may be converted into reduction of flight path and hence faster pulsing and higher sensitivity;

(4) Using frequent pulsing accelerates E-trap response time, which is advantageous when employing E-trap for MS-MS or IMS-MS;

(5) Formation of multiplets allows accurate decoding of the start time; the advantage may be employed for MS below described analyses with time variable ion sources.

There are two visible disadvantages of the method:

(1) The additional spectral decoding step may slow down mass spectrometry analyses.

(2) The encoding and decoding may limit either the complexity of analyzed mixtures or the dynamic range of the analysis.

Slow spectra decoding may be solved by multi-core computation boards (like video boards) which are capable of accelerating massive calculations by factor of multiple thousand. Preferably such multi-core processing is incorporated into a data acquisition board, which would ease requirements onto the bus transfer rate and would allow faster spectra acquisition. The second limitation has been assessed in model simulations, which have shown that raw E-trap spectra can be decoded until the degree of peaks overlapping (raw spectral population) is under ~30%. In order to fully recover the duty cycle of the E-trap orthogonal accelerator, the sensitivity gain $G=\Delta N^*s$ should be about 30. Thus, the degree mass spectra complexity (before multiplets and fast pulsing) should stay under 1% to allow mass spectra recovery.

Indeed, the 1% limit of mass-spectra complexity may affect e.g. LC-MS analysis because of tremendous number of chemical background peaks. However, at the expected 100,000 resolution level, the chemical noise is known to occur at approximately 1E−5 level relatively to major peaks. Thus, the proposed encoding-decoding method may allow 1E+5 dynamic range which matches one in Orbitrap or high resolution LC-TOF. Compared to those instruments, the E-trap is estimated to provide a better combination of sensitivity and speed which may be utilized e.g. for rapid spectra acquisition. Still, it is desirable complimenting the open E-trap analysis with chemical noise suppression, like FAIMS, ion mobility-mass correlated filtering, single charge suppression for acquisition of multiply charged ions, decomposition of chemical noise clusters by heat and ion storage, etc. It is also desirable combining the open E-trap analysis with the below described methods of the upfront ion separation, or ion flow compression—both reducing complexity of encoded spectra in open E-traps.

The 1% limit of mass spectral complexity is not expected to affect such mass spectral analyses as: (a) elemental analysis; (b) environmental analysis with GC-MS; (c) tandem mass spectrometry with MS or IMS being the first stage separator, and the open E-trap being the second stage MS.

Multiple strategies may be used for enhancing the decoding step e.g. by: (a) alternating the pulsed source frequency between two settings and acquiring two independent sets of data; (b) adjusting the inclination angle $\alpha$, this way adjusting span $\Delta N$ in number of reflections within multiplets, and acquiring two settings of data; (c) splitting of ion packets between two detectors, wherein one detector is located at notably smaller Z-distance to minimize or to avoid multiplet formation; (d) sampling a fraction of ions onto an ion to electron converting surface at short Z-distance; and (e) later discussed strategies employing an up-front ion separation or time compression.

Using Upstream Ion Flow Compression

Figure 9:
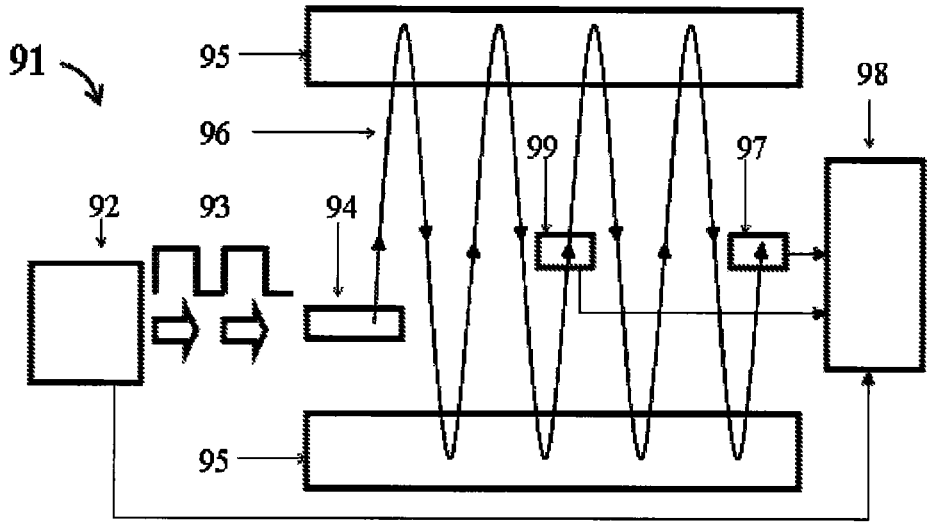
FIG. 9 shows one E-trap embodiment with an orthogonal acceleration out of quasi-continuous ion beam.

Referring to FIG. 9, one group of embodiments of the E-trap mass spectrometer comprises a modulation device 92 generating a quasi-continuous ion flow 93, an orthogonal accelerator 94, a pair of planar gridless ion mirrors 95, an auxiliary detector 99, a main detector 97, and spectra decoding means 98.

In one particular embodiment, the time modulation device 92 comprises a gaseous radiofrequency (RF) ion guide with ion storage and pulsed ejection. Alternatively, the modulating device 92 comprises a gaseous RF ion guide with auxiliary electrodes for controlling axial velocity within the guide, either by axial DC field or by a traveling wave. Yet alternatively, the device 92 employs mass dependent ion release by RF barrier to compress ion arrival time into OA 94 for a wide span of ion m/z.

In operation, the modulation device converts an incoming continuous ion flow (not shown) into a quasi-continuous ion flow 93 with time segments shorter than the period of the modulation. Ions enter orthogonal accelerator 94 and get injected between ion mirrors 95 at high repetition rate to follow jigsaw trajectories 96. The accelerator is driven by a string of start pulses. The duration of the string corresponds to the duration of the quasi-continuous burst within the accelerator. The period between individual start pulses is adjusted sufficiently short to provide nearly unit duty cycle of the orthogonal accelerator. The shorter the burst the smaller the number of start pulses in the string. Ultimately, and accounting the extended Z-length of the orthogonal accelerator compared to conventional MR-TOF, a nearly unit duty cycle may be obtained with a single start pulse. The method improves sensitivity of the open E-trap while reducing the number of ion peaks due to frequent pulsing.

In one embodiment, in order to compress the quasi-continuous flow within the accelerator, the modulator is arranged to eject ions in an inverse sequence of ion m/z. Such modulator may employ either a mass-dependent RF barrier opposed by DC propulsion, or a DC barrier with mass dependent resonance excitation within the RF ion trap, both known in the MS field. Since the delivery time from the modulator to the accelerator is proportional to square root of ion m/z, the method allows delivering ions of wide m/z span simultaneously into the Z-extended accelerator. Then single start pulse may inject ions into the E-trap which would reduce the encoded spectra complexity and the number of overlapping peaks while reaching nearly unit duty cycle of the accelerator.

Optionally, an auxiliary detector 99 samples a small fraction of ion packets at a sufficiently close location to prevent multiplets and overlaps from adjacent injection pulses. The main detector is located much further from the orthogonal accelerator and receives ion packets corresponding to widely spread multiplets and from multiple time shifted pulses to improve spectral resolution. The signal from auxiliary detector 99 is used to assist main signal decoding.

Using Upstream Time Separating Devices

Figure 10A:
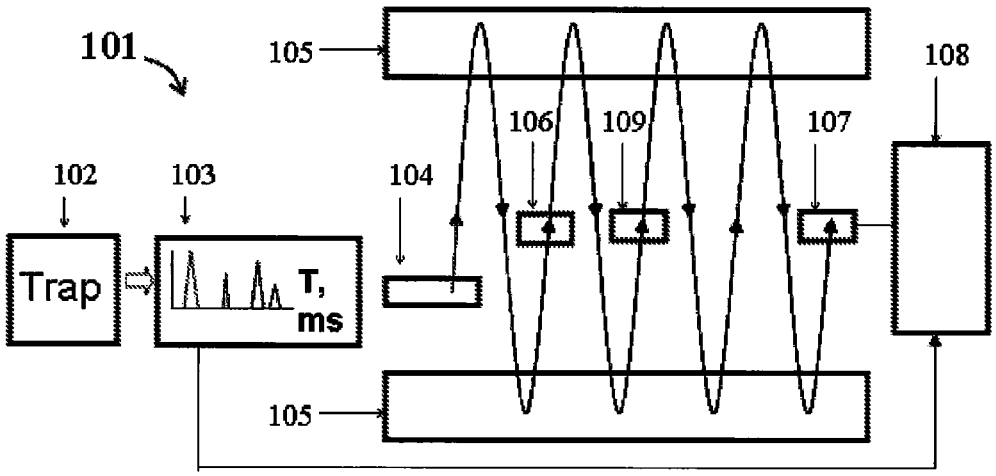
FIG. 10 shows one E-trap embodiment with an upstream ion trapping and ion separation at a millisecond time scale and illustrate how the upfront ion separation reduces peak overlaps and thus improves spectral decoding.

Referring to FIG. 10A, one group of E-trap embodiments 101 comprises an ion trap 102, a first separating device 103, an orthogonal accelerator 104, an electrostatic E-trap analyzer with planar ion mirrors 105, an optional time gate 106, a main detector 107, decoding means 108, and an optional auxiliary detector 109. The device 103 separates the ion flow such that to sequentially release ions within 1 to 10 ms cycle and to group ions either according to m/z, or to ion mobility correlating with the m/z value.

In alternative embodiments, the upfront separating device 103 comprises one separator of the list: (i) an ion mobility spectrometer (IMS) separating ion packets according to ion mobility; (ii) a linear TOF mass spectrometer arranged within a vacuum RF ion guide and operating at low (few tens of eV) ion energy to extend separation time to few milliseconds; (iii) an ion RF channel with a moving radiofrequency wave opposing electrostatic retarding potential; (iv) an RF ion trap with mass selective ion release. In all the embodiments, the first separating device generates a time sequence of ions roughly in the order of ions m/z. Resolution of several tens may be sufficient for the below described method.

In operation, ions enter the orthogonal accelerator 104 in a time sequence, either according to their m/z or ion mobility value. At any given moment, only ions of a narrow mass or mobility fraction get injected between mirrors 105. The accelerator is operated at a high frequency and wide multiplets are recorded on the main detector 107. Data are recorded in the form of long spectra corresponding to the entire separation cycle in the separating device 103. Preferably, multiple long waveforms are summed. Preferably, a fraction of the ion packets is recorded on the auxiliary detector 109 without peaks overlapping to assist the decoding of the main signal on detector 107.

Figure 10B:
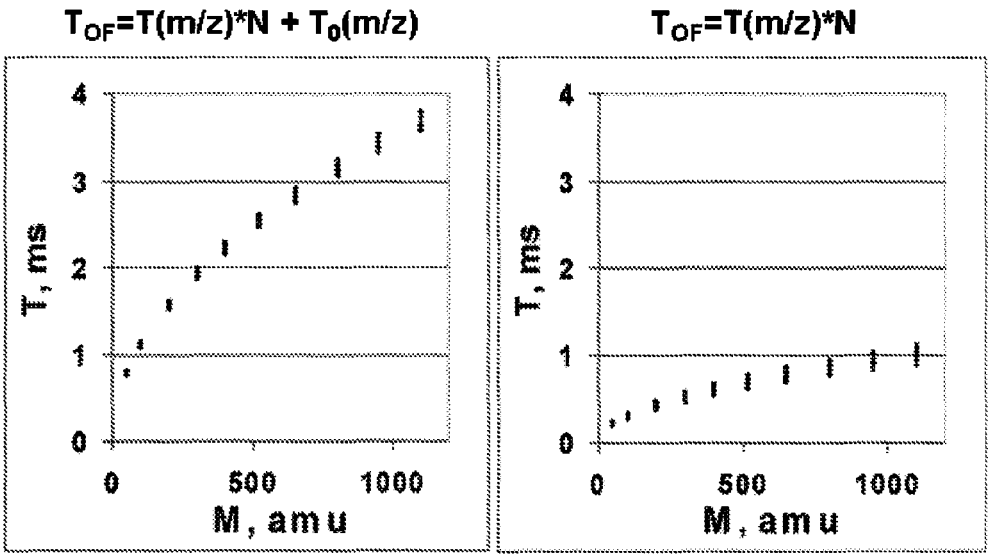

Referring to FIG. 10B, long spectra are acquired corresponding to full length of the separation device 103. As a result, overlaps are avoided between species of significantly different masses. The data decoding should employ the information on the start times of the separating device 103. If using the time separation, the total peak time from the beginning of the separation cycle is $T_{OF}=T(m/z)*N+T_0(m/z)$, where T(m/z) is the m/z dependent time per single reflection, N is the number of reflections in the E-trap, and $T_0(m/z)$ is the m/z dependent time of ion passage through the separating device 103. If not using the time separation, then $T_0=0$. When comparing two cases on graphs denoted by formulae it is apparent that the degree of momentarily peak overlapping in long spectra with the upfront separation is much less than otherwise without the upfront separation. This allows either better spectral decoding or using larger gains in pulse frequency.

After spectral decoding there will appear a time distribution of each particular m/z which may be employed to characterize the separation in the device 103. As an example, such information could be obtained for determining ion mobility for all species. This feature of rapid time separation and of rapid response may be employed for multiple other methods of tandem MS, IMS-CID-MS, for rapid surface scanning and for other experiments requiring tracking short events with the fast pulsing open E-trap.

In another particular embodiment, an optional time gate 106 is employed for chemical noise filtering based on the charge state filtering arranged with the correlated ion mobility-m/z filtering. In this case the upfront separating device 103 is an ion mobility spectrometer, and ions arrive to the accelerator in a time sequence according to ion mobility K. Since $K \sim q/\sigma$, (where $\sigma$ is the mass m and charge q dependent ion cross section), a momentarily mobility fraction contains ions with different charge q and of different m/q. Within the mobility fraction, the lower charge states would have lower m/q values. By filtering out a mobility-correlated lower m/q one can remove e.g. singly charged ions which compose the bulk of chemical noise. Preferably, the ion time gate 106 is set at close vicinity of the accelerator 104, e.g. after single reflection by ion mirror 105, such that ion flight time to the gate 106 is shorter than period between start pulses. Then the time gate would distinguish ions from adjacent start pulses. The main detector 107 would be then detecting multiply charged analyte ions, like peptide ions in proteome analysis with the strongly suppressed chemical background. This would enhance spectral decoding and would improve the dynamic range of LC-MS analysis.

Time Dependent Ion Sources

Figure 11:
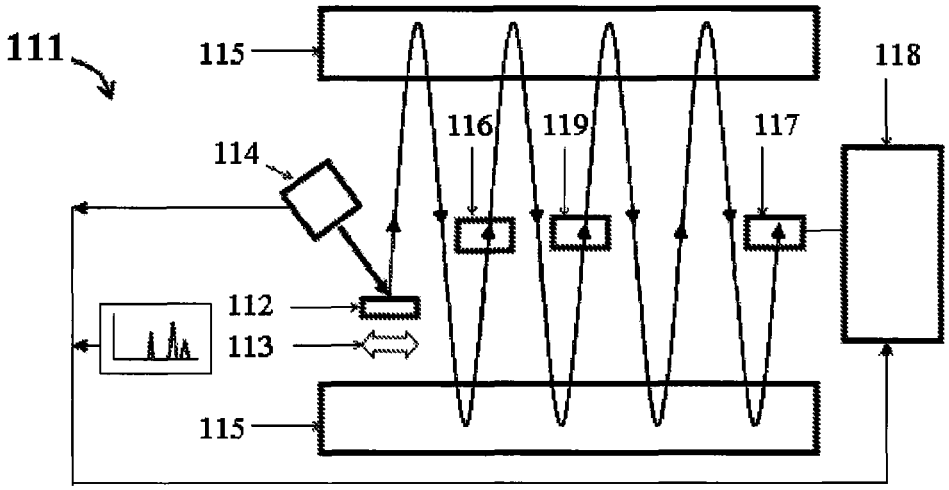
FIG. 11 shows one E-trap embodiment with a time variable pulsed ion source.

Referring to FIG. 11, one group of E-trap embodiments 111 comprises a time-variable ion source, here presented by an example of the analyzed sample plate 112, a spatial scanning device 113, and a pulse source of bombarding particles 114 like fast ion packets, pulsed glow discharge, or light pulses. The embodiment further comprises an electrostatic E-trap analyzer with planar ion mirrors 115, an optional time gate 116, a main detector 117, decoding means 118, and an optional auxiliary detector 119. The information on spatial scanning and on the time of bombarding pulses is fed to the decoding means 108. The embodiment is set up for rapid surface analysis.

In operation, ions are generated in the preset time sequence and injected into the E-trap. It is of principal importance that the period between ionizing pulses is substantially shorter than the flight of the heaviest m/z ions through the E-trap. A long spectrum is acquired per the entire surface scanning experiment. Preferably, spectra are recorded in the data logging regime, wherein the data system on-the-fly determines signals' centroids and integrals and then records the data flow onto the PC memory without the interruption or spectra summation. The E-trap is set up to form multiplets, i.e. signals corresponding to various number of ion reflections per single start pulse and per single ion m/z component. The multiplet peaks are extracted at the spectral decoding stage, and for each multiplet the exact timing of the start pulse is recognized based on: (a) simultaneous occurrence of multiplet peaks; (b) the calibrated intensity distribution within multiplets; (b) the known timing of all start pulses; (c) the limited choice of exact ion masses in case of elemental analysis.

In another embodiment, the method is employed for layer by layer surface analysis, wherein the signal time variation would correspond to the sample depth. Yet in another embodiment, the method is used for aerosol analysis. It is expected that a single aerosol particle would be ionized within randomly occurring ionizing events. In multiple method variations, the aerosol may be confined either by polarizing force of a radiofrequency field or by locally focused light beam. The ionizing pulses may be arranged at a predetermined sequence or may be triggered by a particle scattered light. In all variations there is employed the same principle of the automatic determination of the start pulse exact timing based on the measured timing of multiplet signals.

Ion Trap Converters

Ion trap converters are expected to provide nearly unity duty cycle. Various embodiments correspond to different type of trap converters, their alignments and to different schemes of ion packets steering and splitting.

Figure 12:
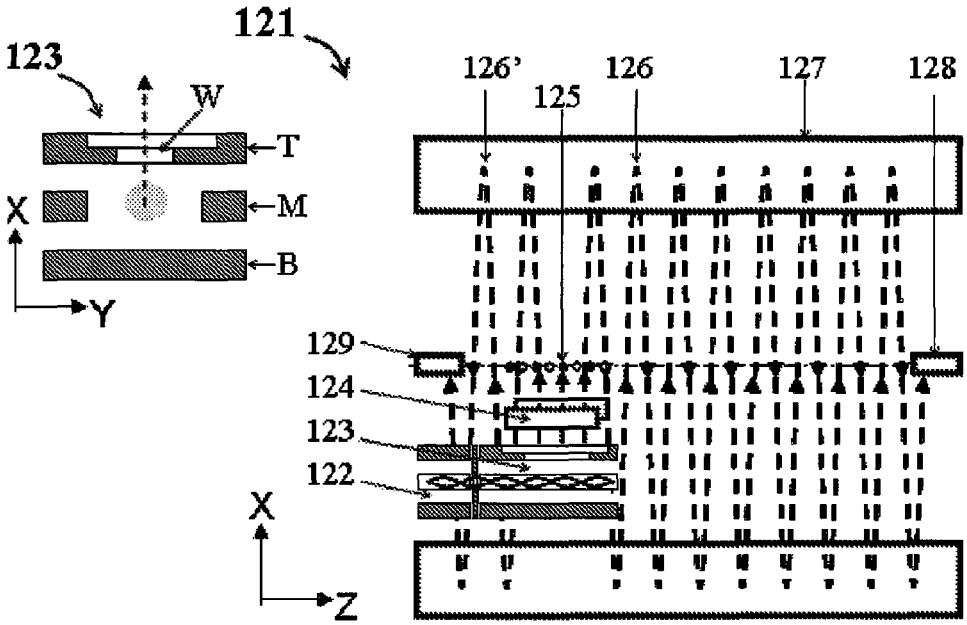
FIG. 12 shows one embodiment with an RF ion trap and with B-N splitter.

Referring to FIG. 12, one preferred embodiment 121 of E-trap employs a rectilinear ion trap converter 123 extended in the Z-direction. The converter comprises top electrode T with a window connected to radiofrequency (RF) signal, middle M and bottom electrodes B connected to pulsed voltages. The embodiment further comprises an upstream gaseous ion guide 122, a dual deflector 124, and an optional splitter 125—either a set of bipolar wires (B-N) or a set of multi-segment deflector plates. The E-trap comprises planar ion mirrors 127, a main 128 and auxiliary 129 detectors. To clear ion path, the ion trap converter 123 is displaced in the Y-direction, and ions are returned onto the X-Z symmetry plane of the E-trap by the pulsed double deflector 124.

In operation, the trapping ion guide 122 passes a quasi-continuous ion flow into the trap converter 123. Ions are confined radial by RF field and get repelled by electrostatic plug (not shown) at the far end of the trap 123. Preferably, fringing field penetrates through the side window W and provides an axial electrostatic well. Ions get collisional dampened and confined within the central portion of the trap after approximately 1-3 ms time at gas pressures of about 100 Pa. Periodically RF signal on middle electrodes M is switched off, and after a small delay (hundreds of nanoseconds) extraction pulses are applied to side electrodes N and B to extract on packets in the X-direction. In the plane of intermediate time focusing (here Z-symmetry axis) the B-N splitter 125 splits the ion packets into two portions 126' and 126, each tilted at a small inclination angle to the X-axis and directed towards the auxiliary 129 and main detector 128 respectively. The detector 129 is set close to the accelerator to avoid multiplets. Medium resolution signal from detector 129 is used for analyzing spectra with a rich content and also for providing a list of peaks for spectra decoding on the main high resolution detector 128.

In one mode of operation, the trap 123 is the vacuum RF trap at gas pressure under 0.1 Pa. Ions get injected into the trap at several electron-Volts (eV) energy and get reflected by repulsing means at the far end of the trap 123. After filling the trap the RF signal on middle electrodes M is switched off and extraction pulses are applied to side electrodes T and B. The extracted ion packets retain small energy along the Z-direction, and after an electrostatic acceleration in the X-direction the packets will appear tilted at small inclination angle to the X-axis. Note that ions which were reflected from the far end would retain the opposite direction along the Z-axis. The trap naturally forms two split sets of ion packets 126' and 126 even without using the B-N splitter 125. The operation mode allows faster pulsing of the trap compared to previously described mode with gaseous ion dampening taking milliseconds. Besides, the low energy (few eV) ion may propagation through the vacuum trap improves the duty cycle compared to conventional orthogonal accelerators, and also allows smaller inclination angles and this way raises the number of ion reflections and, thus, the resolution within compact analyzers.

Figure 13:
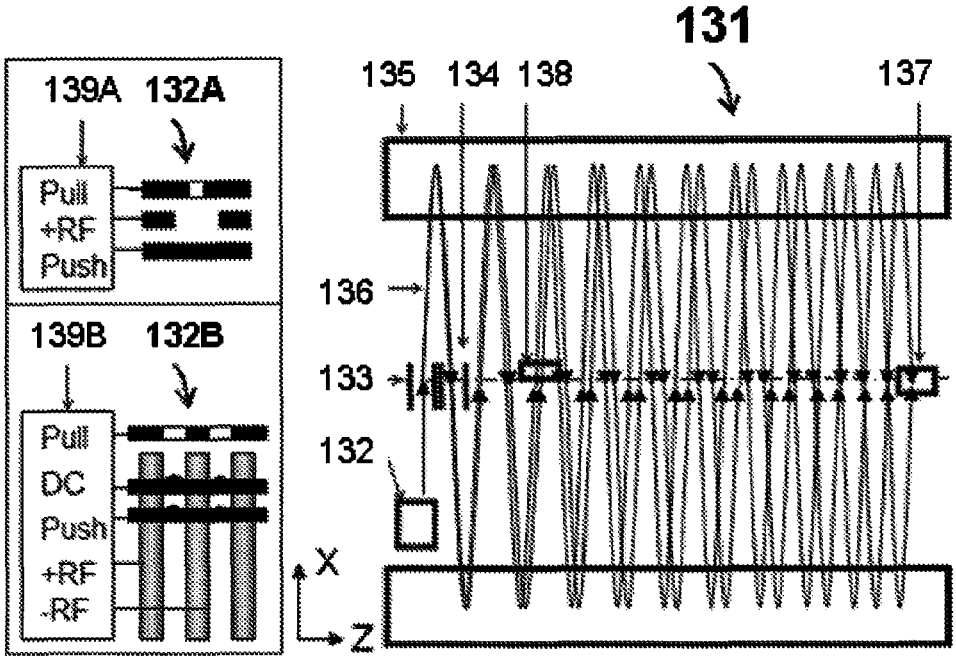
FIG. 13 shows another E-trap embodiment with an RF ion trap.

Referring to FIG. 13, another embodiment 131 comprises an ion trap converter 132, steering means 133, steering means 134, two parallel planar and gridless ion mirrors 135 elongated in the Z-direction, a main 137 and an auxiliary 138 detectors.

In one particular embodiment 132A, the trap 132 comprises a rectilinear RF ion guide with radial ion ejection in the X-direction and with RF electrodes being aligned in the Y-direction as shown in the drawing. The middle electrodes are connected to the 'RF' signal, while outer electrodes are connected to the pulsed 'Push' and 'Pull' voltages of the supply 139A. Optionally, the embodiment employs and array of such radial ejecting traps being multiplexed in the Z-direction.

In another particular embodiment 132B, the trap 132 is a single axially ejecting trap or a linear array of axially ejecting traps, as shown in the drawing. The array comprises at least two rows of RF electrodes (preferably made as a block e.g. by EDM technology) being aligned substantially in the X-directions, and a set of orthogonally aligned auxiliary electrodes which are connected to a static 'Trap' potential and to switching 'Push' and 'Pull' pulses of the supply 139B. The trap array is preferably aligned in the Z-direction. Less preferably, the trap array is aligned in the Y-direction.

In operation, a quasi-continuous ion flow is provided from an ion guide with modulation means (both not shown). Ions get dampened in presence of radial RF field at approximately 100 Pa gas pressure and get confined within combined RF and electrostatic wells. Periodically, every 1-3 ms sufficient for gaseous dampening, the trap ejects ion packets along the X-direction. To clear ion path ions are steered by deflector 133 and steered back by a deflector 134, while leaving some inclination angle for ion Z-drift in the E-trap analyzer. The described double deflection partially compensates the tilting of time-fronts. Alternatively, the trap 132 is tilted to Z axis at the angle $\alpha$ to displace ions in the Z-direction, and after single of few ion reflections, the ion packets are steered back by the deflector 134 at a slightly smaller angle. Since ion traps 132A and 132B have moderate Z-width, the steering is expected to have limited effect onto ion packet time spread.

Preferably, the deflector 134 comprises a wide aperture 'Einzel' lens with long focal length corresponding to several ion reflections. Ions which avoided sampling by the auxiliary detector 138 would reach the main detector 137. Ions arrive after a number of reflections N. The span $\Delta N$ depends on the initial divergence and on the energy spread of ion packets, so as on the adjustment of the optional focusing means 134. In one particular mode of operation, the focusing means 134 are adjusted to minimize the spread $\Delta N$ within multiplets. In another mode of operation, in order to increase space charge capacity of the analyzer the focusing means 134 are adjusted to keep at least 3-4 multiplets in spectra. In one operational method, the focusing means 134 are switched between the two above modes, and two sets of spectra are acquired to assist the signal decoding. Yet in another operational method, the deflection angle in deflector 133 is varied in time such that to reduce deflection for heavier mass species and this way to reduce signal overlapping between multiplet signals.

Open E-Trap Geometries

Figure 14:
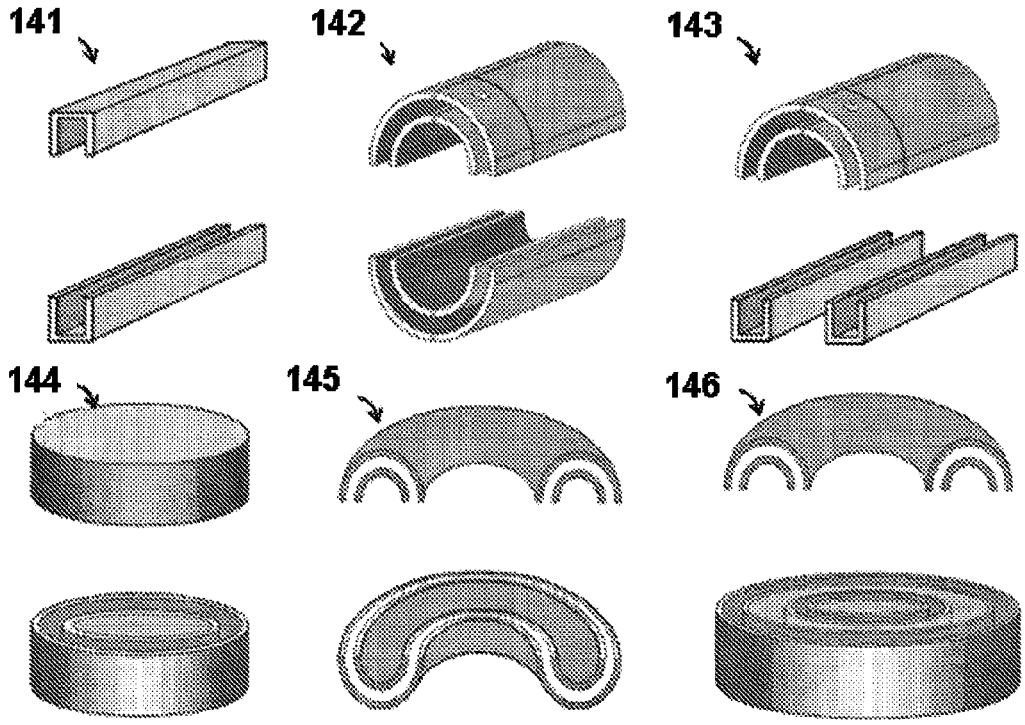
FIG. 14 depicts exemplar geometries of the open E-traps.

The open E-trap may employ a variety of electrode geometries and various topology of the analyzer electrostatic field, as described in the co-pending application "Ion Trap Mass Spectrometer", incorporated herein by reference. Referring to FIG. 14, to form a two-dimensional electrostatic field, the electrode subsets may be either ion mirrors as in the embodiments 141 and 144, or electrostatic sectors—142 and 145, or a combination of the two—143 and 146. Those fields may be either extended linearly along the Z-axis as shown for embodiments 141-143 or wrapped into torroids around a circular Z-axis as in the embodiments 144-146. The ion mirrors confine ions along the reflection axis X and due to the spatial focusing allow indefinite ion confinement along the Y-axis. The sectors confine ions along the main ion trajectory in X-Y plane due to spatial focusing along the curved trajectory. Electrostatic sectors are capable of compensating all the first order time-of-flight aberrations, while ion mirrors (even in combination with sectors) allow compensation all the aberrations up to the second order and some of third order aberrations.

A wider variety of purely two-dimensional fields which may be formed by curving any of X, Y or Z axes into circles and by tilting the circle plane relative to the plane of the main ion trajectory. Such traps usually form circular or torroidal electrode surfaces. In the above embodiments 141-146, the purely two-dimensional field does not provide any field in the drift Z-direction, i.e. Z-component of ion velocity stays unchanged. Thus, such fields allow free ion propagation in the Z-direction, i.e. makes the trap open.

The disclosed method is also applicable to fully trapping electrostatic traps, i.e. confining ions indefinitely in all three directions, like orbital traps. The ion escape is proposed by draining a portion of ion packets through the use of semitransparent set of ion-to-electron conversion surfaces. Such surfaces may be curved to follow the curvature of the equipotential lines in the 3-D traps.

The described trap geometries allow multiplexing, i.e. within the same set of electrodes, making multiple set of aligned slits and thus way forming multiple trapping volumes operating as multiple analyzers. The multiplexing can be formed either by linear array of slits or rotational array. The multiplicity of analyzers may be connected either to a single ion source or pulsed converter. Then either fractions or time slices of the same ion flow may be analyzed in parallel within multiple analyzers. Alternatively, multiple ion sources or pulsed converters are used for individual injection per every analyzer. Those multiple sources may be similar, just for improving response time or the throughput of the analysis. As an example, in the surface analysis multiple spots could be scanned simultaneously and the grid of spots could be canned. Alternatively, different types of sources are used for obtaining the complimentary information. As an example channels could be employed for parallel analysis of parent mass and for exploring multiple channels of ion fragmentation. A channel may be used for calibration purpose, etc.

Other Types of Open Traps

The general method of an open trap analysis with multiplet recording may be employed for other types of electrostatic ion traps. As an example, orbital time-of-flight mass spectrometers with hyper-logarithmic field of SU19853840525, incorporated herein by reference, arrange cyclic ion motion along spiral trajectories. Ion packets displace and spread in the angular direction, which makes it difficult to arrange the predetermined ion path. However, if using an ion conversion surface on the ion path, ions can be detected per every cycle to form multiplets. In another example, a three dimensional electrostatic ion trap of WO2009001909, incorporated herein by reference, provides ion cyclic motion with a limited stability in one direction. By detecting ion after passing the trap, there may be formed multiplet signal. Similarly, in the three dimensional electrostatic trap of DE102007024858, incorporated herein by reference, ions may be injected at sufficiently large inclination angle to form an ion passage through the trap with a large number of ion reflections within some span to form multiplet signals. In those exemplar highly isochronous traps, the ion packets may be selectively excited to larger amplitudes of ion oscillations, this way recording signals sequentially for limited spans of ion m/z which would simplify signal decoding.

Figure 15:
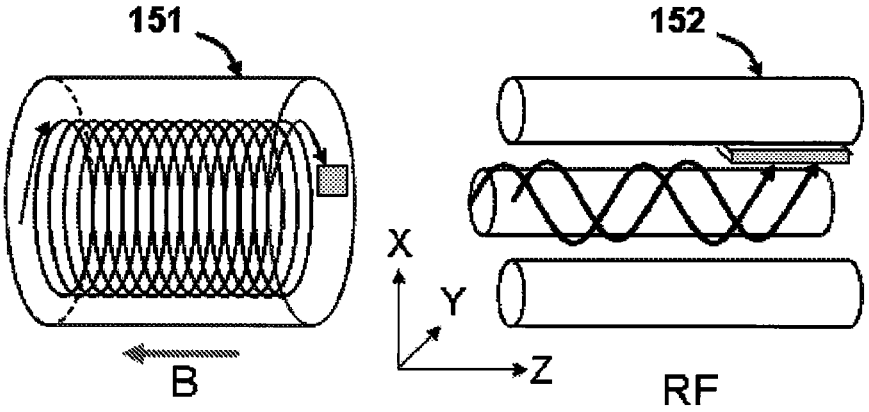
FIG. 15 illustrates open ion traps using magnetic and radiofrequency fields.

Referring to FIG. 15, the general method of an open trap analysis with multiplet recording may be employed for other types of non-electrostatic ion traps like magnetic traps 151 and radio-frequency ion traps 152. In both cases, ions propagate through the trap in one Z-direction, while experiencing isochronous ion oscillations in the orthogonal plane X-Y. Once ions reach the detector region at far Z-end, they form a sharp signal corresponding to an integer number of oscillations N. Naturally occurring spread in axial velocity $V_Z$ is likely to cause a spread in number of reflections N, thus causing multiplet signals. In magnetic field trap 151, ions are preferably excited by ion injection at constant momentum (e.g. by a short accelerating pulse) to provide mass independent rotational radii. In RF linear trap 152, ions are preferably excited to larger orbits by a single dipolar pulse also providing same momentum for all m/z components, This helps exciting heavier ions to larger amplitudes despite of RF well being proportional to 1/(m/z).

Most Preferred Embodiment

The most preferred embodiment of electrostatic open trap mass spectrometer comprises a torroidal electrostatic open trap 144 as in FIG. 14 being constructed of two parallel ion mirrors. Preferably, ion mirrors comprise a radial deflecting electrode. The torroidal E-trap provides exceptionally long drift dimension per package size. As an example, a compact 300 mm diameter E-trap analyzer has almost 1 m perimeter. At typical 3 degree inclination angle of ion trajectory and at approximately 700 mm cap-to-cap distance the effective flight path reaches approximately 20 m. Preferably, ion mirrors comprise at least four electrodes and an attracting lens for at least third order temporal and at least second order spatial isochronicity. The preferred embodiment further comprises an upstream accumulating ion guide as shown in FIG. 9, and an orthogonal accelerator 61 with the extended Z-length as in FIG. 6 and being displaced in radial (Y) direction as in FIG. 7. Preferably, the accelerator is fast pulsed as illustrated in FIG. 8 to provide a nearly unit duty cycle of the pulsed conversion.

Compared to prior-art TOF MS, the open E-trap provides a better combination of resolution (above hundred thousand), almost unit duty cycle, an extended space charge capacity of the analysis (up to E+8 ions/sec), and an improved dynamic range of the TOF type detector. The embodiment is well suited for MS-only, IMS-MS and MS-MS analysis. The down side is in the additional spectral decoding while accounting frequent start pulses and multiplets formation. The decoding may be accelerated with multi-core processors, preferably incorporated into the data acquisition board.

Although the present invention has been describing with reference to preferred embodiments, it will be apparent to those skilled in the art that various modifications in form and detail may be made without departing from the scope of the present invention as set forth in the accompanying claims.

What is claimed is:

1. A method of mass spectral analysis comprising the following steps:

(a) passing ion packets through electrostatic, radiofrequency or magnetic fields providing isochronous ion oscillations;

(b) recording time-of-flight spectra corresponding to a span of integer numbers ion oscillation cycles (multiplet);

(c) sampling a portion of ion packet per single oscillation for generating multiplet signals per every ion m/z specie, and wherein the value of said sampled ion portion is set to provide m/z independent intensity distribution within multiplets; and (d) reconstructing mass spectra from multiplet containing signals, wherein the reconstructed mass spectra are capable of being used for mass spectral analysis.

2. A method of mass spectral analysis comprising the following steps:

(a) forming ion packets of multiple species from an analyzed sample;

(b) arranging an electrostatic field which provides spatial ion trapping in at least two directions and an isochronous ion motion along a central ion trajectory;

(c) injecting said ion packets for ion passage through said electrostatic field wherein said ion packets are capable of forming multiple ion oscillations;

(d) detecting ions and measuring ion packets flight times (multiplets) at a detector for an integer number N of ion oscillation cycles within a span ΔN; and (e) reconstructing mass spectra from said detected signals containing multiplets, wherein the reconstructed mass spectra are capable of being used for mass spectral analysis, wherein said detection step comprises a step of sampling a portion of ion packet per single oscillation for generating multiplet signals per every ion m/z specie, and wherein the value of said sampled ion portion is set to provide m/z independent intensity distribution within multiplets.

3. A method as in claim 2, wherein said electrostatic field comprises a substantially two-dimensional electrostatic field in an X-Y plane extended in a locally orthogonal Z-direction; and wherein said ion injection is arranged at an inclination angle α to axis X to form an average shift $Z_1$ in the Z-direction per single ion oscillation cycle.

4. A method as in claim 2, further comprising a step of spatial ion focusing in the Z-direction; and further comprising a step of adjusting angular and spatial spreads of injected ion packets at the injection step; and wherein both said Z-focusing and ion packet adjustments are arranged to control the span and intensity distribution within the multiplets either m/z independent and determined in calibration experiments, or an m/z dependent for the purpose of reducing the number of overlapped signal peaks.

5. A method as in claim 4, wherein parameters of the method are adjusted to maintain the span ΔN of peaks within multiplets as one of the group: (i) 1; (ii) from 2 to 3; (iii) from 3 to 5; (iv) from 5 to 10; (v) from 10 to 20; (vi) from 20 to 50; and (vii) over 100.

6. A method as in claim 2, wherein for the purpose of enhancing duty cycle of said ion injection step, the method comprises at least one step of the group: (i) setting the Z-length of the injected ion packets longer than an average shift $Z_1$ per single ion cycle; (ii) setting the Z-length of said detector or said converter being larger than the average shift $Z_1$ per single ion cycle; (iii) setting ion injection at shorter period than the flight time of the largest m/z ion specie within the electrostatic field, while acquiring long signal corresponding to a string of said frequent injection pulses; and (iv) using an upfront ion accumulation device.

7. A method as in claim 2, further comprising one step of ion upfront separation of the group: (i) steps of parent ion mass-to-charge separation and fragmentation; (ii) ion separation according to their mobility or their differential mobility; (iii) steps of ion mobility separation followed by a correlated m/z filtering within the electrostatic trap; and (iv) steps of ion trapping and of crude time-of-flight separation followed by ion injection with periods less than the flight time in said E-trap of the largest m/z ion specie.

8. A method as in claim 2, further comprising a step of multiplexing said electrostatic field volumes within the same set of electrodes; and further comprising a step of distributing ion packets into said electrostatic field volumes for parallel and independent mass analysis from either single or multiple ion sources.

9. A method as in claim 2, wherein said step of ion injection comprises a step of a pulsed orthogonal acceleration in the X-direction out of a continuous or quasi-continuous ion beam.

10. A method as in claim 9, wherein said step of orthogonal acceleration is enhanced by at least one step of the group: (i) controlling the number of ion cycles in said E-trap by adjusting the energy of said continuous ion beam; (ii) setting larger length of said orthogonal accelerator versus a shift $Z_1$ per single ion cycle; (iii) displacing said orthogonal accelerator in the Y-direction and returning ion packets onto X-Z plane of said E-trap; (iv) arranging shorter period between accelerating pulses versus flight time of the heaviest ion specie; (v) accumulating ions and pulse injecting a quasi-continuous ion flow followed by a string of frequent accelerating pulses; and (vi) confining said ion beam within said accelerator in transverse directions either by periodic electrostatic field or by radio-frequency field.

11. A method as in claim 2, further comprising a step of ion packets formation within a pulsed ion source which varies at the time scale comparable to ion flight time in the E-trap; further comprising a step of recognizing the time of ion generating pulse by the time pattern within the signal multiplets; and wherein said step of ion packets formation comprises one step of the group: (i) bombardment of an analyzed scanned surface by particle or light pulses; (ii) randomly ionizing aerosol particles; (iii) ionizing a sample outlet of ultra-fast separation device; and (iv) ionizing samples within rapidly multiplexed ion sources.

12. An algorithm of decoding multiplet containing spectra in open isochronous ion traps comprising the following steps:

(a) calibrating the intensity distribution within multiplets I(N) in reference spectra;

(b) detecting peaks in raw spectra and composing a peak list with data on their centroids $T_{OF}$, intensities I, and peak widths dT;

(c) constructing a matrix of candidate flight times per single reflection $t=T_{OF}/N$, corresponding to raw peaks $T_{OF}$ values and to guessed numbers of reflections N;

(d) selecting likely t values corresponding to multiple hits and gathering groups of corresponding $T_{OF}$ values; i.e. hypothetical multiplets;

(e) verifying peaks validity within the group by analyzing distribution of $T_{OF}$ and intensities I(N) within hypothetical multiplets;

(f) checking $T_{OF}$ overlaps between groups, and discarding overlapping peaks;

(g) recovering correct hypotheses of T (normalized flight times) and intensity I(T) using valid peaks of the group; and (h) accounting for number of discarded positions to recover the expected intensities I(T).

13. An open electrostatic trap mass spectrometer (E-trap) comprising:

(a) a pulsed ion source or a pulsed converter to form ion packets from said ions;

(b) a set of electrostatic trap electrodes substantially extended in a Z-direction to form a substantially two-dimensional electrostatic field in the orthogonal X-Y plane;

(c) the shape of said trap electrodes and their potentials are adjusted to provide cyclic ion oscillations and a spatial confinement of said ion packets in said X-Y plane, as well as an isochronous ion motion along a central ion trajectory;

(d) said pulsed source or pulsed converter is arranged to inject ion packets at an inclination angle α to the X-axis for ion passage through said electrostatic field while forming multiple oscillations within said X-Y plane and an average shift $Z_1$ in the Z-direction per single ion oscillation;

(e) a detector located at $X=X_D$ plane for measuring ion packets flight times-after an integer number N of ion oscillations, varying within some span ΔN, and thus forming signal 'multiplets' for any m/z ion specie;

(f) means for reconstructing mass spectra from the detector signal containing multiplets; and (g) an ion-to-electron converter sampling a portion of ion packets per single ion cycle, wherein secondary electrons are sampled from both sides of said ion converter, and wherein the converter comprises a decelerator for matching the time focal plane with the converter surface plane.

14. An E-trap as in claim 13, wherein said set of electrostatic trap electrodes comprises one electrode set of the group: (i) at least two electrostatic ion mirrors; (ii) at least two electrostatic sectors; and (iii) at least one ion mirror and at least one electrostatic sector.

15. An E-trap as in claim 13, wherein the sensitivity of said E-trap is improved by at least one mean of the group: (i) the Z-length of said detector is set larger than the average shift $Z_1$ per single ion cycle; (ii) the Z-length of said pulsed converter is set larger than the average shift $Z_1$ per single ion cycle; (iii) said pulsed converter is energized at a shorter period than the flight time of the heaviest m/z ion specie to the detector; and (iv) said pulsed converter is preceded by an accumulating ion guide.

16. An E-trap as in claim 13, wherein said pulsed converter comprises an orthogonal accelerator; wherein said orthogonally accelerator is displaced in the Y-direction compared to the X-Z plane of central ion trajectory; and wherein said orthogonal accelerator comprises one device of the group: (i) parallel plates with a window for pulsed ion extraction; (ii) an RF ion guide at substantially vacuum conditions being in communication with an upstream gaseous RF ion guide; (iii) a linear RF ion trap at gaseous conditions; and (iv) an electrostatic ion guide.

17. An E-trap as in claim 13, further comprising at least one ion separator of the group: (i) a mass-to-charge separator, (ii) an ion mobility or differential ion mobility separator; and (iii) any of the above ion separators followed by a fragmentation cell.

18. An E-trap as in claim 13, further comprising a radiofrequency ion trap and either a crude time-of-flight separator or an ion mobility separator prior to an orthogonal accelerator with frequent pulse extractions being arranged at much shorter periods relative to the flight time to a detector of the heaviest m/z ion specie.

* * * * *